US009939760B2

(12) United States Patent
Komatsu

(10) Patent No.: US 9,939,760 B2
(45) Date of Patent: Apr. 10, 2018

(54) IMAGE FORMING APPARATUS

(71) Applicant: CANON KABUSHIKI KAISHA, Tokyo (JP)

(72) Inventor: Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/376,940

(22) Filed: Dec. 13, 2016

(65) Prior Publication Data

US 2017/0185014 A1 Jun. 29, 2017

(30) Foreign Application Priority Data

Dec. 24, 2015 (JP) ..... 2015-252520
Sep. 28, 2016 (JP) ..... 2016-189955

(51) Int. Cl.
*G03G 15/20* (2006.01)
*G03G 15/10* (2006.01)

(52) U.S. Cl.
CPC ..... *G03G 15/2007* (2013.01); *G03G 15/10* (2013.01); *G03G 15/2039* (2013.01); *G03G 2215/0626* (2013.01)

(58) Field of Classification Search
CPC .. G03G 15/2007; G03G 15/201; G03G 15/10; G03G 15/11; G03G 15/657; G03G 2215/0626
See application file for complete search history.

(56) References Cited

U.S. PATENT DOCUMENTS 6,461,782 B1 * 10/2002 Sasada ..... G03G 9/08791 430/108.1
9,348,252 B2 5/2016 Higuchi et al.
2002/0136574 A1 9/2002 Bartscher et al.
(Continued)

FOREIGN PATENT DOCUMENTS

JP 2002-137375 A 5/2002
JP 2007-83574 A 4/2007
(Continued)

OTHER PUBLICATIONS

European Search Report issued in corresponding European Application No. 16204217.0 dated Jun. 8, 2017.
(Continued)

*Primary Examiner* — Carla Therrien
(74) *Attorney, Agent, or Firm* — Fitzpatrick, Cella, Harper & Scinto

(57) ABSTRACT

An image forming apparatus includes a recording material feeding portion, an image forming portion, and a heating portion. An ultraviolet irradiating portion irradiates an image on a recording material with ultraviolet radiation, when the recording material is in an ultraviolet irradiation positon and is already heated by the heating portion, and a detecting portion detects a temperature of the recording material which has not yet been heated by the heating portion. In addition, a controller controls an output of the heating portion depending on the detected temperature so that the temperature of the recording material, when the recording material heated by the heating portion enters the ultraviolet irradiation position, is within a target temperature range that is set in advance.

16 Claims, 19 Drawing Sheets

(56) References Cited

U.S. PATENT DOCUMENTS

| | | | | |
|---|---|---|---|---|
| 2009/0233216 | A1* | 9/2009 | Teshima | G03G 9/125<br>430/115 |
| 2015/0192875 | A1 | 7/2015 | Ito et al. | |
| 2016/0349676 | A1* | 12/2016 | Takahashi | G03G 15/2007 |

FOREIGN PATENT DOCUMENTS

| | | | |
|---|---|---|---|
| JP | 2015-127812 | A | 7/2015 |
| WO | 2014/157344 | A1 | 10/2014 |

OTHER PUBLICATIONS

Copending, unpublished U.S. Appl. No. 15/384,516, filed Dec. 20, 2016, to Isao Komatsu.

* cited by examiner

| | DATA A | | DATA B | |
|---|---|---|---|---|
| SHEET TEMP. | POWER | RANK | POWER | RANK |
| 20℃ | 150W | 3 | 100W | 2 |
| 10℃ | 350W | 3 | 100W | 1 |
| 5℃ | 450W | 3 | 100W | 1 |

| KIND*1 | B.W. *2 (gsm) | BIF*3 (℃) | AIF*4 (℃) | TIAIRI (100W)*5 (℃) | TIAIRI (600W)*6 (℃) |
|---|---|---|---|---|---|
| P. P. | 81 | 22 | 31 | 40 | 75 |
| C. P. | 81 | 22 | 31 | 40 | 75 |
| P. P. | 157 | 22 | 27 | 32 | 49 |
| C. P. | 157 | 22 | 27 | 32 | 49 |
| P. P. | 300 | 22 | 25 | 28 | 40 |
| C. P. | 300 | 22 | 25 | 28 | 40 |

*1 : "KIND" is the kind of paper. "P.P." is plain paper. "C.P." is coated paper.
*2 : "B.W." is a basis weight.
*3 : "BIF" is the temperature (in cassette) before image formation.
*4 : "AIF" is the temperature after image formation.
*5 : "TIAIRI (100W)" is the temperature immediately after IR irradiation at 100W.
*6 : "TIAIRI (600W)" is the temperature immediately after IR irradiation at 600W.

Fig. 12

| SHEET TEMP. (℃) | SUPPLIED POWER (W) |
|---|---|
| . . . | . . . |
| 5～10 | 450 |
| 10～20 | 350 |
| 20～25 | 150 |
| . . . | . . . |

Fig. 15

IMAGE FORMING APPARATUS

FIELD OF THE INVENTION AND RELATED ART

The present invention relates to an image forming apparatus of an electrophotographic type.

Conventionally, in the image forming apparatus of the electrophotographic type, a constitution using a liquid developer has been known.

Japanese Laid-Open Patent Application (JP-A) 2015-127812 discloses a constitution of an image forming apparatus using a liquid developer of an ultraviolet curable type, in which the liquid developer transferred on a recording material (medium) is irradiated with ultraviolet radiation (rays), so that an image is fixed on the recording material.

However, a state of the recording material (recording material) is different depending on an ambient (environmental) temperature of the recording material. Particularly, in the case where the temperature of the recording material used in image formation is low, a temperature of a curable agent contained in the liquid developer lowers by contact with the recording material. For that reason, as in JP-A 2015-127812, only by irradiation with the ultraviolet radiation by an ultraviolet irradiating device, there was a liability that ultraviolet irradiation energy supplied to the liquid developer on the recording material is insufficient and a degree of curing of the liquid developer is insufficient. As a result, there was a liability of a lowering in adhesiveness between the liquid developer and the recording material (improper fixing).

On the other hand, in a constitution in which a heater for always heating the recording material with an output necessary to sufficiently heat a low-temperature surface of the recording material is provided, the following problem occurs. That is, in the case where the temperature of the recording material is high, the recording material is heated with an excessive output, so that there is a liability that the excessive output leads to an increase in electric power consumption of the heater.

SUMMARY OF THE INVENTION

A principal object of the present invention is to provide an image forming apparatus, of an electrophotographic type using a liquid developer of an ultraviolet curable type, capable of suppressing an increase in electric power consumption of a heating portion for heating recording material while suppressing generation of improper fixing.

According to an aspect of the present invention, there is provided an image forming apparatus comprising: a recording material feeding portion configured to feed a recording material from an accommodating portion configured to accommodate the recording material; an image forming portion configured to form an image, on the recording material fed by the recording material feeding portion, with a liquid developer containing toner and an ultraviolet curable agent; an ultraviolet irradiating portion configured to irradiate the image, with ultraviolet radiation, formed on the recording material by the image forming portion; a heating portion configured to heat the recording material on a feeding path of the recording material from a recording material feeding position where the recording material feeding portion feeds the recording material to an ultraviolet irradiation position where the image is irradiated with the ultraviolet radiation by the ultraviolet irradiating portion; a detecting portion configured to detect a temperature of the recording material; and a controller configured to control an output of the heating portion depending on the temperature of the recording material detected by the detecting portion so that the temperature of the recording material is within a target temperature range.

Further features of the present invention will become apparent from the following description of exemplary embodiments with reference to the attached drawings.

BRIEF DESCRIPTION OF THE DRAWINGS

FIG. 12 is a table showing an example of a difference in temperature rise depending on a kind and a basis weight of the recording material.

FIG. 15 is a table showing an example of setting of supplied electric power depending on the temperature of the recording material.

DESCRIPTION OF THE EMBODIMENTS

Embodiments of the present invention will be described specifically with reference to the drawings. Constituent elements described in the following embodiments are only examples, and are not intended to limit the present invention to those described in the embodiments.

[Embodiment 1]

(General Structure of Image Forming Apparatus)

Figure 1:
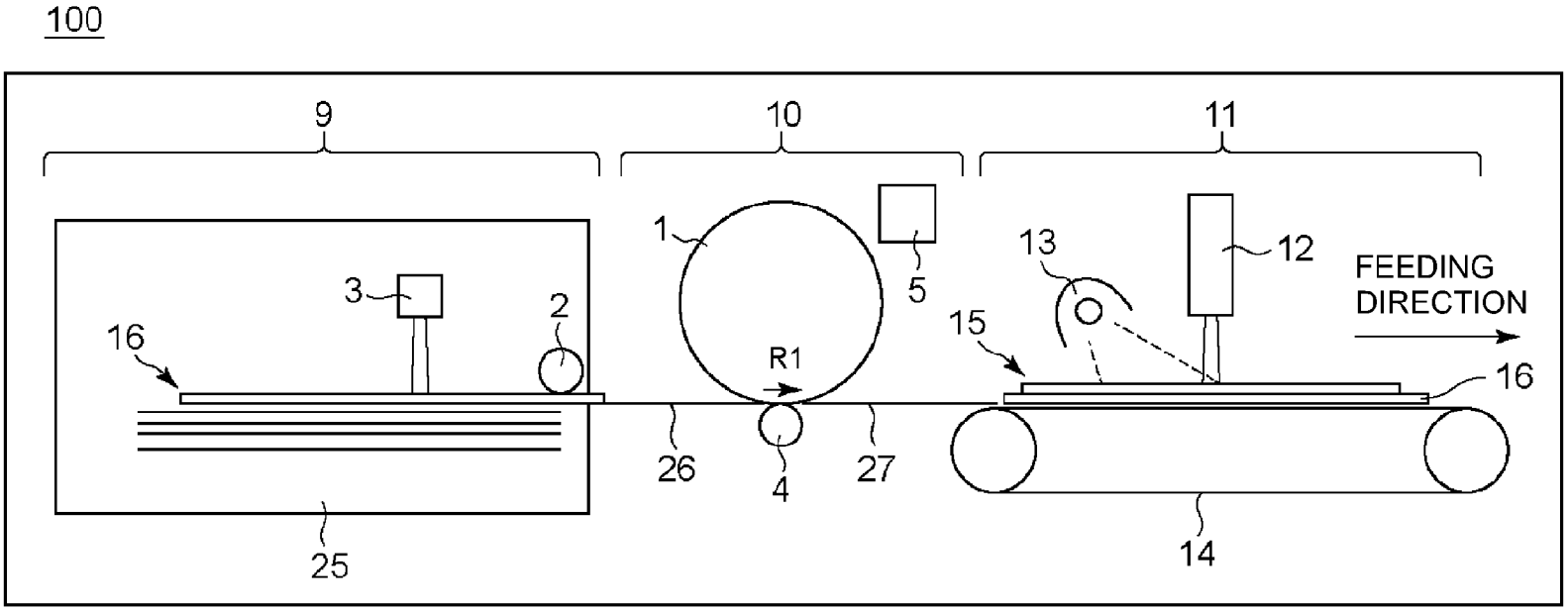
FIG. 1 is a schematic view showing a general structure of an image forming apparatus.
Figure 2:
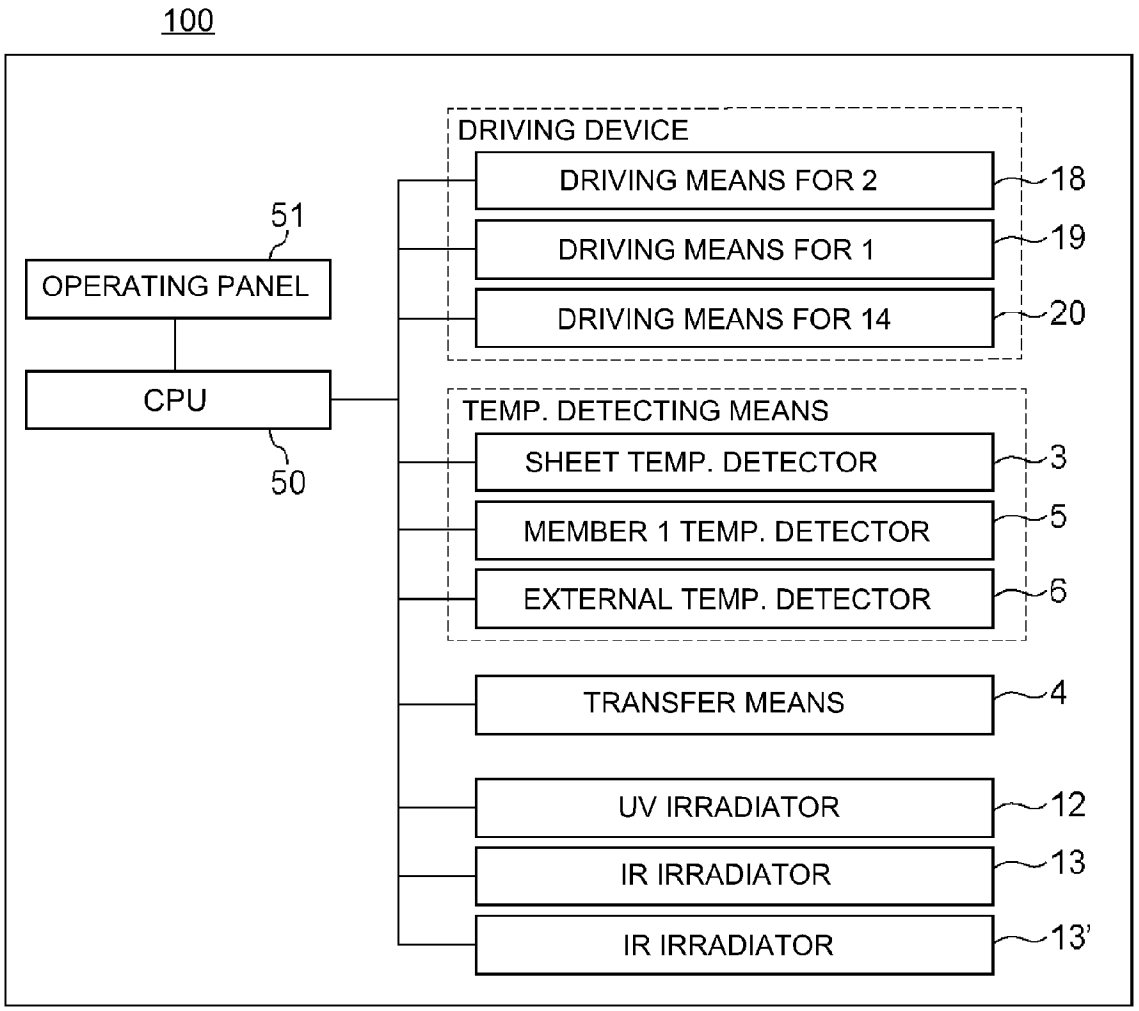
FIG. 2 is a block diagram showing a constitution of control of the image forming apparatus.

FIG. 1 is a schematic view showing a general structure of an image forming apparatus. FIG. 2 is a block diagram showing a constitution of control of the image forming apparatus.

An image forming apparatus 100 includes an operating panel 51 (FIG. 2). The operating panel 51 includes a display panel as a displaying means (display portion) for displaying information by an instruction from a CPU (central processing unit) 50 as a controlling portion (controller) and includes operating buttons as an inputting means (input portion) for inputting an instruction by an operator. The operating panel 51 displays a state of the image forming apparatus and a menu when various settings are made.

The CPU 50 functions as a controller for effecting integrated control of an operation of the image forming apparatus 100. The CPU 50 executes control of various devices electrically connected with the CPU 50 in accordance with programs and data stored in a storing means (such as an electronic memory) incorporated therein. For example, the CPU 50 is connected with a driving means 18 for a feeding mechanism 2, a driving means 19 for an image holding (bearing) member 1 and a driving means 20 for a feeding belt 14, and control drive and stop of the drive of each of the driving means. Further, the CPU 50 is connected with a temperature detecting means 3 of a recording material (medium), a temperature detecting means 5 of the image holding member 1 and an external temperature detecting means 6, and acquires measured values. Further, the CPU 50 is electrically connected with an ultraviolet irradiating device 12 and an infrared irradiating device 13 which are described later, and controls ON/OFF of these means and outputs of these means.

Incidentally, the storing means is not limited to one incorporated in the CPU 50, but may also have a constitution in which a memory electrically connected with the CPU 50 is provided separately from the CPU 50 and functions as a storing means for storing the programs and data.

As shown in FIG. 1, the image forming apparatus 100 includes a recording material feeding portion 9, an image forming portion 10, and a fixing portion 11.

The recording material feeding portion 9 includes a cassette 25 as an accommodating portion for accommodating a recording material 16 used in image formation and the feeding mechanism 2 for feeding the recording material 16 accommodated in the cassette 25 toward the image forming portion 10. The feeding mechanism 2 is a recording material feeding roller, for example, and feeds the recording material 16 in the cassette 25 to a feeding path 26. The feeding mechanism 2 is driven by the driving means 18 for the feeding mechanism 2. Incidentally, the accommodating portion may also have a tray shape (e.g., a manual feeding tray).

Further, the recording material feeding portion 9 includes the recording material (sheet) temperature detecting means 3 for detecting a temperature of the recording material 16 before image formation. The recording material temperature detecting means 3 measures a surface temperature of the recording material 16 subjected to the image formation. For example, the temperature detecting means 3 is provided in the neighborhood of the feeding mechanism 2 and measures the surface temperature of the recording material 16 fed by the feeding mechanism 2. Further, for example, the temperature detecting means 3 is disposed inside the cassette 25 (accommodating portion) and measures the surface temperature of an uppermost sheet (subsequently fed by the feeding mechanism 2) of sheets of the recording material 16 accommodated in the cassette 25. In this embodiment, as the recording material temperature detecting means 3, a radiation thermometer (e.g., "IT-450", manufactured by HORIBA Ltd.) of a non-contact type is used.

Here, the recording material (recording material) 16 is a recording material on which a toner image is formed by the image forming apparatus, and at least includes sheets, such as plain paper principally consisting of pulp and a filler, and coated paper having a surface layer which is a coating layer of kaolin or calcium carbonate, or the like, and a resin material. The sheets may also include a postcard and an envelope. The image forming apparatus 100 may also have a constitution in which the image forming apparatus 100 is capable of forming the image on an OHP sheet, a film, or the like. In this embodiment, as the recording material 16 on which the image is formed by the image forming apparatus 100, the case where the plain paper or coated paper having a basis weight of 52-300 g/m$^2$ (gsm) will be described as an example.

The type of the recording material 16 used in image formation is inputted from the operating panel 51 by the operator. The CPU (acquiring portion) 50 acquires information on the recording material 16 by receiving input of a value of the basis weight of the recording material 16 used through the operating panel 51. Incidentally, the image forming apparatus 100 may also employ a constitution in which the image forming apparatus 100 is connectable with an external device (e.g., a personal computer or an information terminal) via a network and in which selection of the kind (plain paper or coated paper) of the recording material 16 used and the input of the value of the basis weight of the recording material 16 used are received from the external device.

In this embodiment, a constitution in which as the recording material 16, a cut sheet (e.g., A4-sized sheet (210 mm×297 mm) or the like) is used is employed, but a constitution in which rolled paper is used as the recording material 16 may also be employed.

The recording material 16 fed from the cassette 25 by the feeding mechanism 2 passes through a feeding path 26 and is supplied to a contact portion between the image holding member 1 and a transfer means 4. After the image on the image holding member 1 is transferred onto the recording material 16, the recording material 16 passes through a feeding path 27 and is fed to the fixing portion 11.

The image forming portion 10 forms the image with a liquid developer (liquid) 15 on the recording material (recording material) 16. The liquid developer 15 is a developer containing an ultraviolet curable agent curable by ultraviolet radiation (rays) and a coloring material (colorant), and will be described specifically later. The image forming portion 10 includes a roller-shaped image holding member 1 and a roller-shaped transfer means 5. An image forming means (not shown) of an electrophotographic type includes a charging portion, in which the image holding member 1 is electrically charged to a uniform surface potential, an exposure portion, in which a latent image is formed by light exposure, and a developing portion, in which the latent image is developed using the liquid developer 15, and forms the image on the image holding member 1. The image formed on the image holding member 1 is transferred by a transfer roller as the transfer means 4 onto the recording material 16 supplied to a contact portion (image forming position) between the image holding member 1 and the transfer means 4. That is, by the image forming portion 10, an unfixed image is formed on the recording material 16.

The image holding member 1 in this embodiment is an aluminum-made cylinder (photosensitive drum) which has an organic photosensitive layer of 3 mm in thickness and which has an outer diameter of 84 mm, and is 370 mm in long-side width (i.e., a length with respect to a direction substantially perpendicular to a recording material feeding direction). The image holding member 1 is rotationally driven about a center supporting shaft (axis) at a process speed (peripheral speed) of 800 mm/sec in an arrow R1 direction in FIG. 1 by a driving motor (DC brush-less motor) as the driving means 19 for the image holding member 1. The image holding member 1 includes a heater (not shown) as a heating means at an inside thereof, and is provided with the temperature detecting means 5 for the image holding member 1 in the neighborhood thereof. As the temperature detecting means 5 for the image holding member 1, a thermistor or a thermocouple may suitably be used.

In this embodiment, the constitution of the image holding member 1 uses a direct transfer type of the electrophotographic type, but an image forming method on the recording material 16 is not limited thereto. For example, a constitution using an intermediary transfer type in which the image holding member 1 is an intermediary transfer belt may also be employed. Specifically, the image formed on the photosensitive drum with the liquid developer 15 by the image forming means (not shown) is primary-transferred onto the intermediary transfer member by a primary transfer roller. The transfer means 4 is used as a secondary transfer roller and transfers the image from the intermediary transfer member onto the recording material 16.

The recording material 16 on which the image is formed at the image forming portion 10 is irradiated with the ultraviolet radiation by the ultraviolet irradiating device 12.

The surface of the image holding member 1 in this embodiment is temperature-controlled at 40±5° C., and also a temperature of the liquid developer 15 is approximately 40±5° C. on the image holding member 1. In the case in which a temperature of the recording material 16 fed to the image holding member 1 is lower than the temperature of the image holding member 1, the temperature of the liquid developer 15 is lowered by the transfer of the image onto the recording material 16. On the other hand, with the transfer, the temperature of the recording material 16 is increased to some extent by the image holding member 1 and the liquid developer 15. Temperature rise at the time of the transfer of the image with the liquid developer 15 will be described later.

The image forming apparatus 100 includes the infrared irradiating device (infrared input irradiating portion) 13 as a heating portion for heating the recording material 16, which is an object to be irradiated, with the ultraviolet radiation by the ultraviolet irradiating device (ultraviolet irradiating portion) 12. The heating portion 13 is provided for heating the recording material 16 before the recording material 16 is irradiated with the first radiation by the ultraviolet irradiating device 12, and is provided on a feeding path (e.g., the feeding path 26, the feeding path 27, and the feeding belt 14) between a recording material feeding position, at which the recording material 16 is fed by the recording material feeding portion 9, to an ultraviolet irradiation position, at which the recording material 16 is irradiated with the ultraviolet radiation by the ultraviolet irradiating device 12. In this embodiment, the recording material feeding position refers to a boundary position between the cassette 25 and the feeding path 26. Further, in this embodiment, the ultraviolet irradiation position refers to a position in which, in a positional distribution, with respect to the feeding direction of the recording material 16, illuminance by the ultraviolet irradiating device 12 is at a maximum (peak illuminance).

In this embodiment, in order to heat the recording material 16 after the image formation (i.e., after the transfer) and before the irradiation with the ultraviolet radiation, the infrared irradiating device 13 is provided downstream of the image holding member 1 and upstream of the ultraviolet irradiating device 12 with respect to the feeding direction of the recording material 16 (FIG. 1). By the infrared irradiating device 13, after the image formation and before the irradiation with the ultraviolet radiation, a surface of the recording material 16, on which the image which has not been irradiated with the ultraviolet radiation is formed, is irradiated with the ultraviolet radiation.

Incidentally, a constitution in which the cassette 25, in which the recording material 16 before the image formation is accommodated, is provided with a warming means may also preferably be employed. As the warming means for the cassette 25, a heat generation element or the like consisting of a resistor is effectively used.

The recording material 16, on which the image on the image holding member 1 is transferred by the transfer means 4, is fed to the fixing portion 11. The fixing portion 11 includes the ultraviolet irradiating device 12 and the feeding belt 14, and fixes the image of the liquid developer 15 on the recording material 16 by irradiating the recording material 16 with the ultraviolet radiation by the ultraviolet irradiating device 12. The feeding belt 14 feeds the recording material 16, on which the unfixed image is carried, to a position below the ultraviolet irradiating device 12.

(Ultraviolet Irradiating Device)

The ultraviolet irradiating device 12 uses, as a light source, an LED (light emitting diode) 31 for radiating the ultraviolet radiation. Of importance to ultraviolet curing reaction is first law of photochemistry (Grotthuss-Drapper's law), i.e., that a photochemical change is caused only by a fraction of incident light which is absorbed by a substance. That is, in the ultraviolet curing reaction, it is important that an absorption wavelength of a photopolymerization initiator contained in the developer and an emission wavelength of the ultraviolet irradiating device 12 coincide with each other. As regards the wavelength of the LED, there are LED light sources with peaks (spectral distribution peak of radiant energy density) at 365±5 nm, 385±5 nm, 405±5 nm and the like, and therefore, the absorption wavelength of the photopolymerization initiator may preferably fall within these wavelength ranges (regions).

Figure 3:
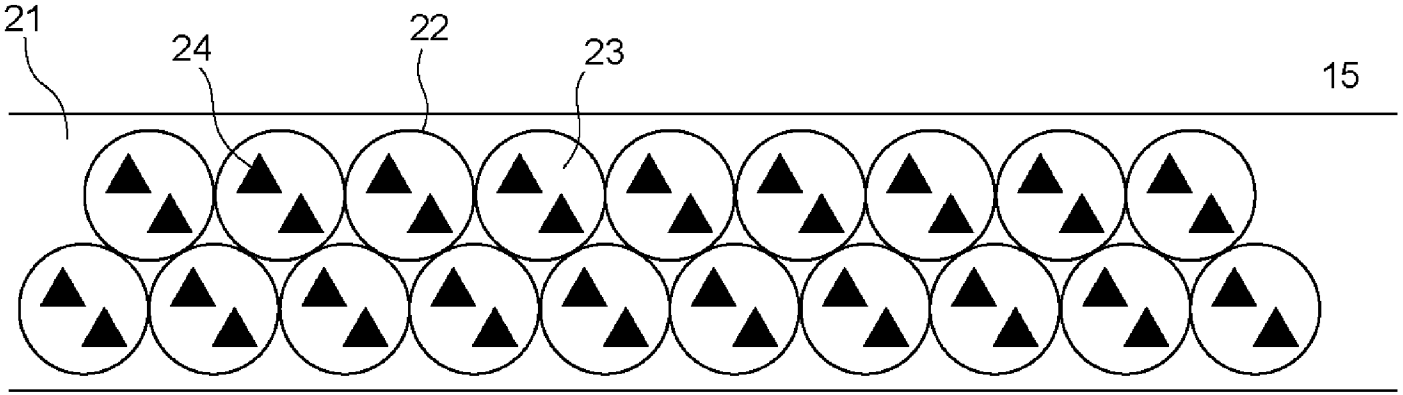
FIG. 3 is a schematic view showing a cross-section of a developer curable by ultraviolet radiation.

FIG. 3 is a schematic view showing a cross-section of the liquid developer 15 to be cured by the ultraviolet radiation (rays). The liquid developer 15 contains an ultraviolet curable agent 21 and toner 22. The ultraviolet curable agent 21 at least contains the photopolymerization initiator and a monomer for the ultraviolet curable agent. The toner 22 contains a resin material 23 as a base material and a coloring material 24. For example, in the case of a cationic polymerization, when the ultraviolet curable agent is irradiated with the ultraviolet radiation, the photopolymerization initiator excited by the ultraviolet radiation generates an acid, and the generated acid and the monomer start a polymerization reaction, so that the ultraviolet curable agent 21 is cured.

Figure 4:
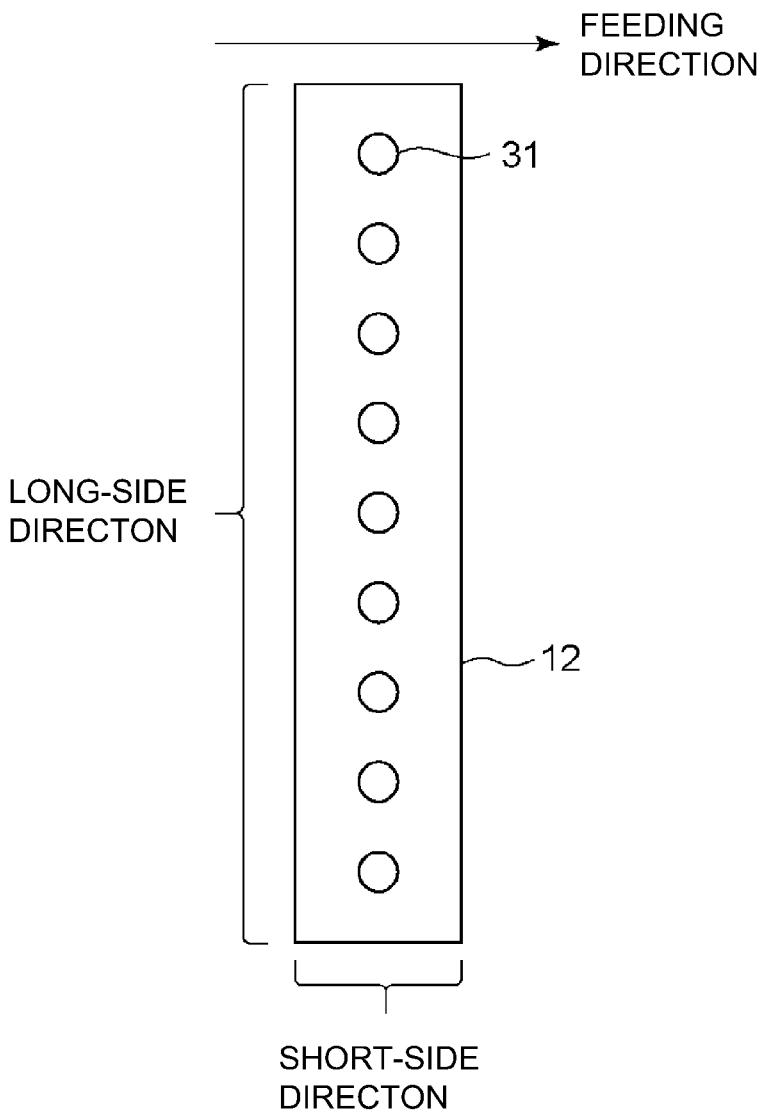
FIG. 4 is a schematic view showing an example of arrangement of an LED of an ultraviolet irradiating device.

FIG. 4 is a schematic view showing an example of arrangement of the LED of the ultraviolet irradiating device 12. LEDs 31 radiating the ultraviolet radiation are disposed so as to oppose a region of the feeding belt 14 contacting the recording material 16 fed, and radiate the ultraviolet radiation to the recording material 16 on the feeding belt 14.

Here, the ultraviolet irradiating device 12 includes the plurality of LEDs 31 so as to irradiate an entire region of the image with the ultraviolet radiation with respect to a widthwise direction (perpendicular to the feeding direction) of the recording material 16. The LEDs 31 radiating the ultraviolet radiation may have a constitution in which the LEDs 31 are arranged in a line along a long-side direction perpendicular to the feeding direction, as shown in FIG. 4, and may also have a constitution in which a plurality of arrays, each having the LEDs 31, as shown in FIG. 4, are arranged in a plurality of lines along the feeding direction.

Figure 5:
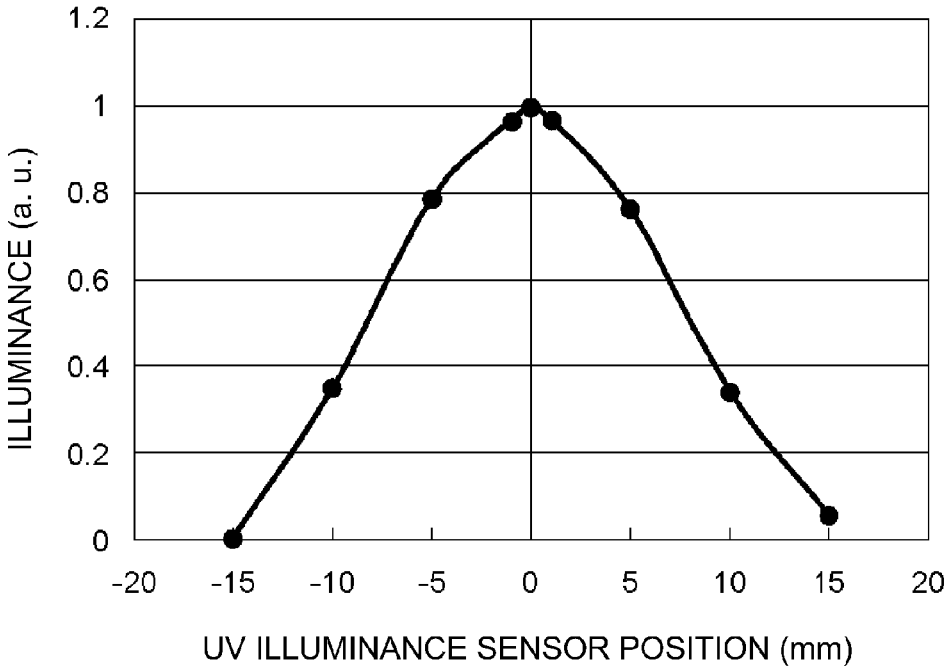
FIG. 5 is a graph showing an illuminance distribution of the ultraviolet irradiating device relative to a position with respect to a recording material feeding direction.

FIG. 5 is a graph showing an illuminance distribution of the ultraviolet irradiating device relative to a position of an illuminance sensor with respect to the recording material feeding direction. Specifically, FIG. 5 shows the illuminance distribution of the ultraviolet irradiating device 12 in which the peak (spectral distribution peak of the radiant energy density) is in the wavelength range of 385±5 nm and a value thereof is 1.8 W/cm$^2$. In FIG. 5, the position of the illuminance sensor immediately below the LEDs 31 is 0 (mm), and the LEDs 31 are provided at different positions with respect to the feeding direction of the recording material 16 and the illuminance by the ultraviolet irradiating device 12 is measured. That is, FIG. 5 shows the illuminance distribution of the ultraviolet irradiating device 12 relative to the position of the illuminance sensor with respect to the feeding direction of the recording material 16. In a positional distribution on a surface of an object to be irradiated with respect to the feeding direction, the illuminance which is a maximum illuminance is referred to as peak illuminance. In FIG. 5, the illuminance at the position (where the ultraviolet illuminance sensor position is 0 (mm)) immediately below the LEDs 31 is the peak illuminance.

Figure 8:
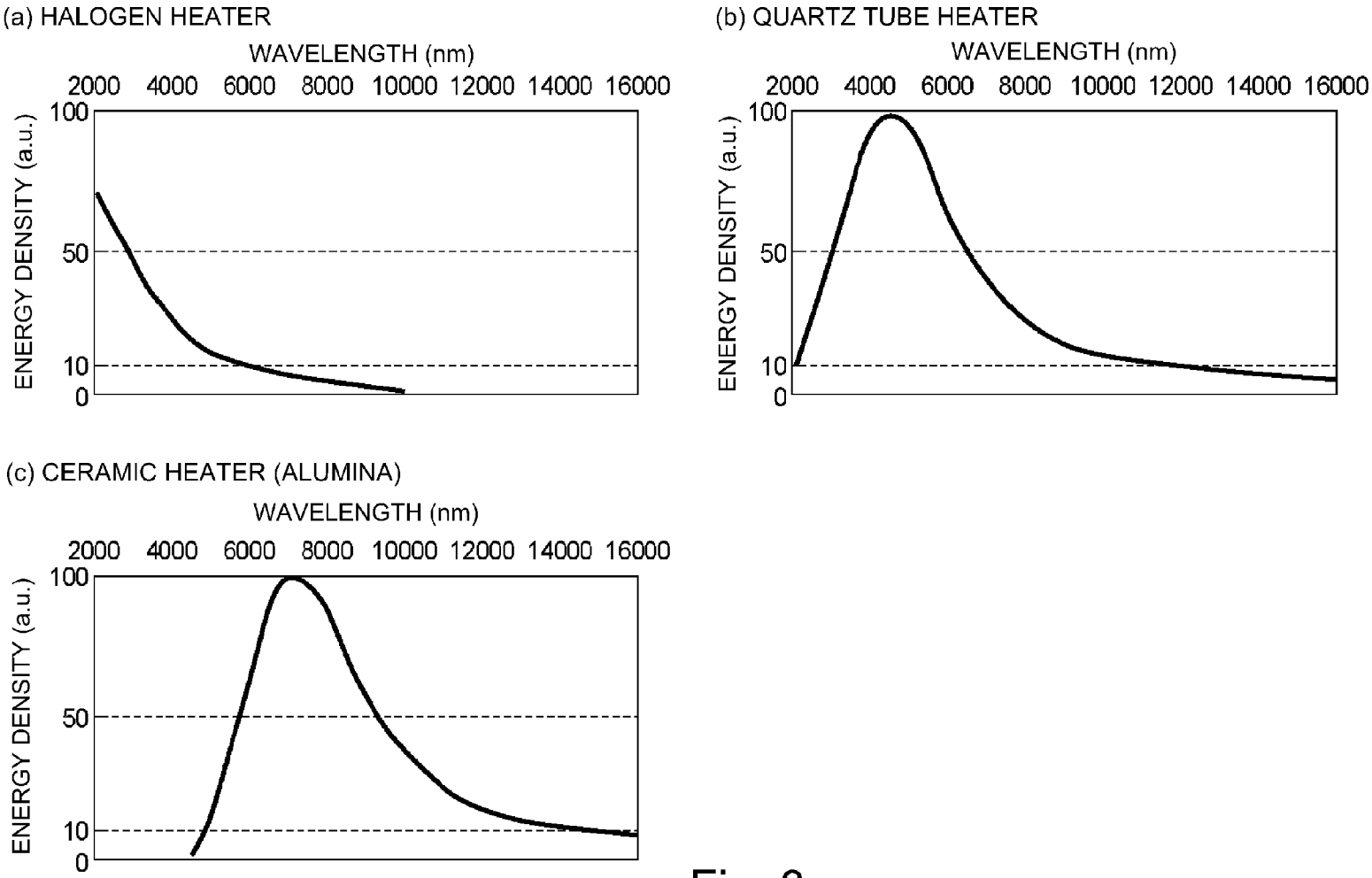
In FIG. 8, (*a*) to (*c*) are graphs each showing spectral radiant energy density of a heater.
Figure 9:
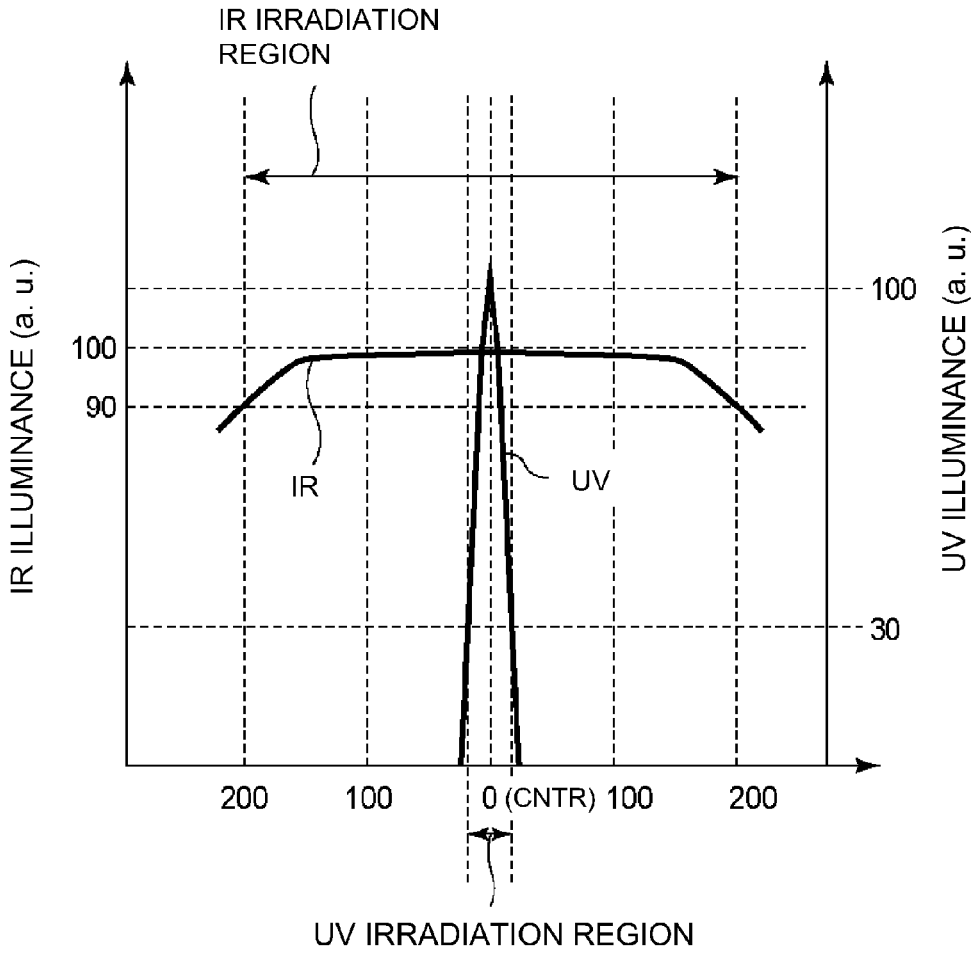
FIG. 9 is a graph showing an illuminance distribution of each of the ultraviolet irradiating device and an infrared irradiating device relative to the position of the recording material with respect to the feeding direction.

In FIG. 5, the unit "(a.u.)" represents an arbitrary unit. This is true for also FIGS. 8 and 9. Further, the irradiation energy (radiant energy) per unit area is a total amount (integrated light quantity: mJ/cm$^2$) of photons which reach the surface of the object to be irradiated. That is, the illuminance shown in FIGS. 5 and 9 is the product of integrated illuminance (mW/cm$^2$) and irradiation time (sec), i.e., (mW/cm$^2$)×(sec), of the ultraviolet irradiation position at each wavelength.

(Infrared Irradiating Device)

The infrared irradiating device 13 radiates electromagnetic wave (infrared input radiation) from a light source with a far-infrared input region wavelength (1000 nm-15000 nm). A vibration absorption wavelength of a chemical bond contained in the recording material 16 is in a far-infrared input region (range), and therefore the recording material 16 can be efficiently heated by being irradiated with the infrared input radiation in the far-infrared input region corresponding to the absorption wavelength of the recording material 16.

As a member for radiating the infrared input radiation, for example, a halogen heater, a quartz tube heater and a ceramic heater exist. In FIG. 8, (a) to (c) are graphs each showing spectral radiant energy density of the associated heater, in which (a) shows the spectral radiant energy density of the halogen heater, (b) shows the spectral radiant energy density of the quartz tube heater, and (c) shows the spectral radiant energy density of the ceramic heater. In these figures, the ordinate represents the spectral radiant energy density when a maximum of the spectral distribution peak of the radiant energy density at the far-infrared input region wavelength (1000 nm-15000 nm) is 100.

The halogen heater is a heater such that a tungsten filament is heated by being energized and the infrared input radiation (about 800 nm-about 5500 nm) is radiated. The quartz tube heater is a heater such that a nichrome wire filament is heated by being energized and the infrared input radiation (about 2000 nm-about 11000 nm) is radiated. The ceramic heater is capable of radiating a long-wavelength infrared input radiation (about 6000 nm-about 14000 nm) in the case of alumina. Here, values in parentheses show wavelength regions (ranges) in which when the maximum of the spectral radiant energy density in the far-infrared input region in the associated heater is 100%, the spectral radiant energy density is not less than 10% of the maximum.

Figure 6:
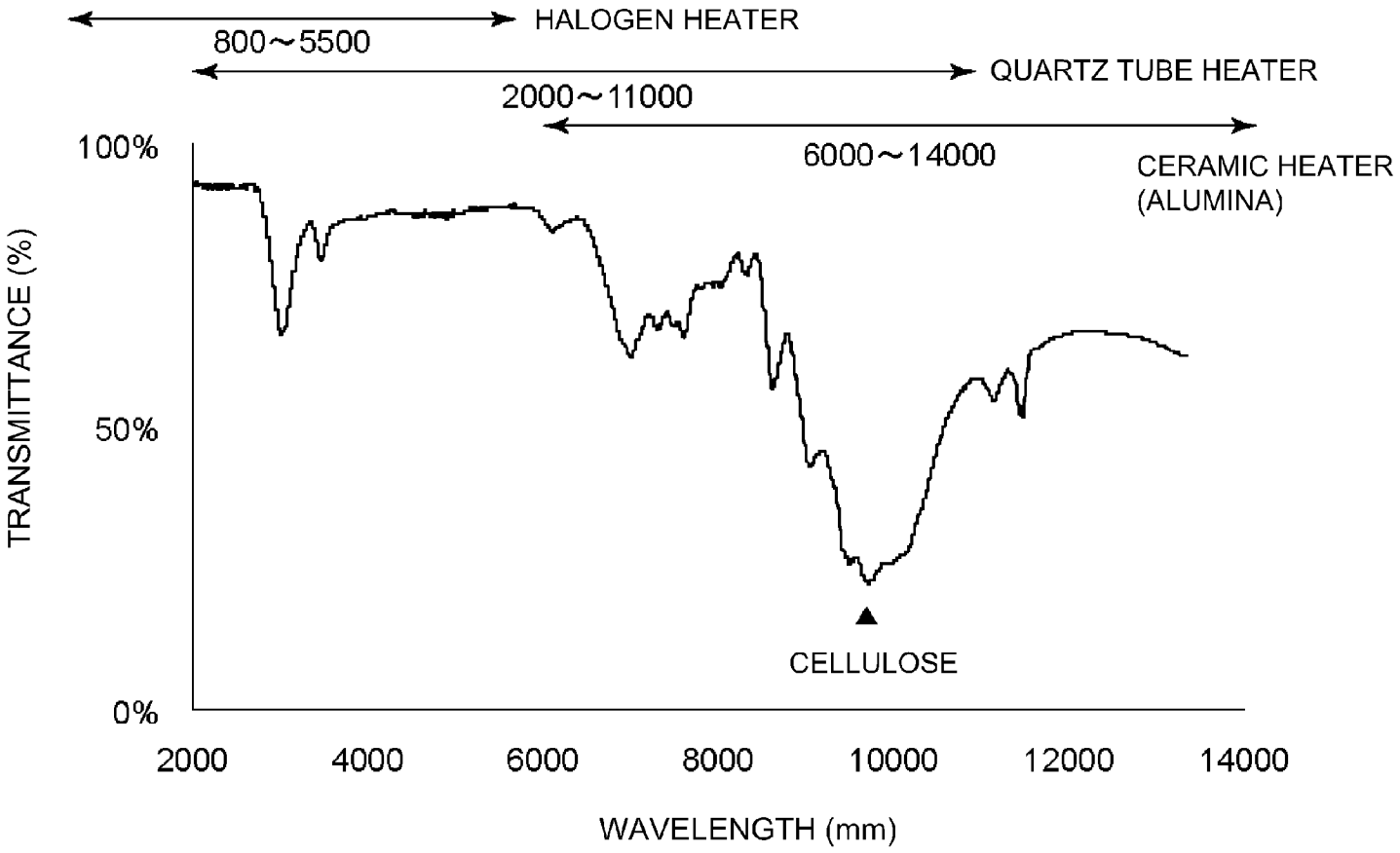
FIG. 6 is a graph showing an example of an absorption wavelength distribution of plain paper.

FIG. 6 is a graph showing an example of an absorption wavelength distribution of the plain paper. The plain paper has an absorption wavelength resulting from cellulose in the neighborhood of about 9700 nm, and therefore, when the plain paper is irradiated with the infrared input radiation, the plain paper absorbs a corresponding infrared input wavelength.

Figure 7:
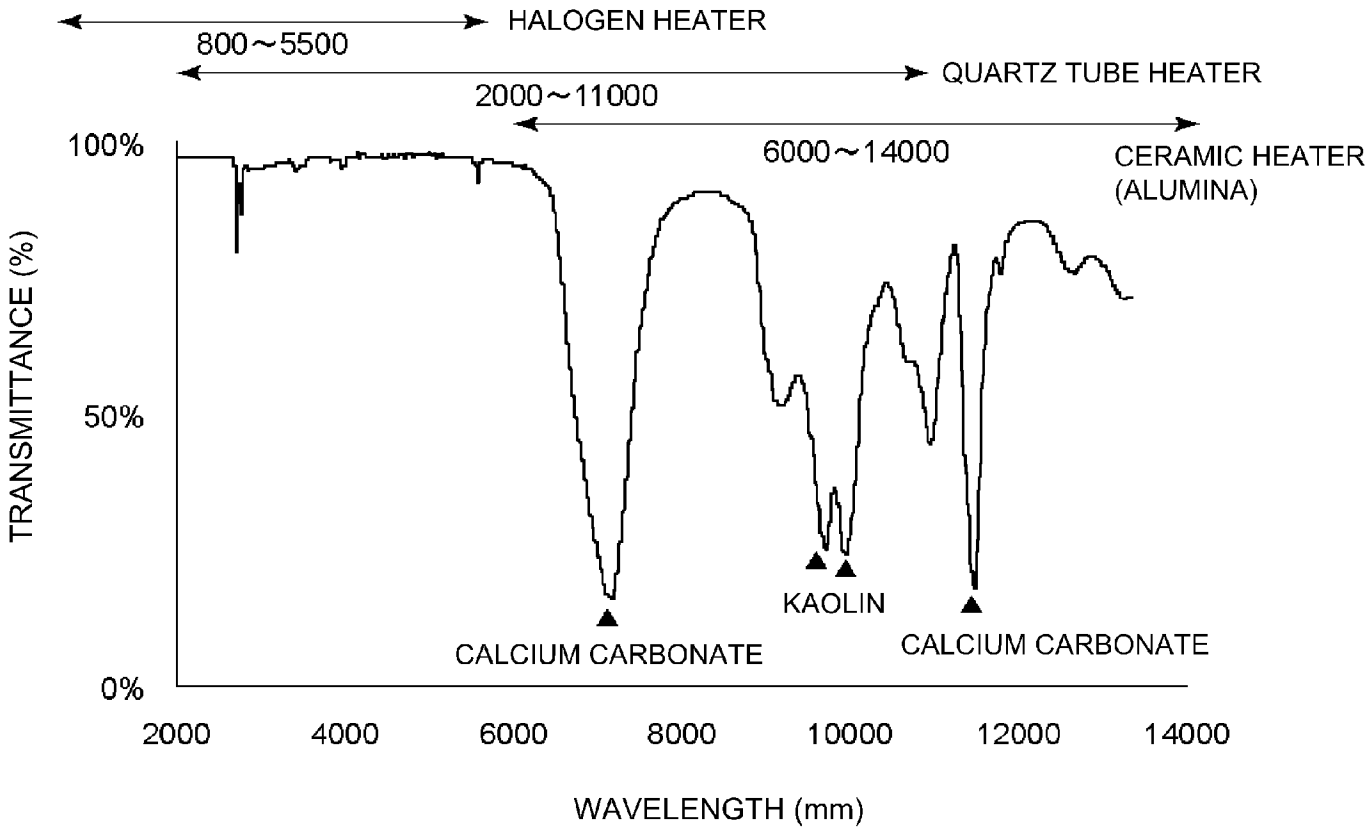
FIG. 7 is a graph showing an example of an absorption wavelength distribution of coated paper.

FIG. 7 is a graph showing an example of an absorption wavelength distribution of the coated paper. Most of the coated paper contains calcium carbonate and/or kaolin. The coated paper shown in FIG. 7 contains both of calcium carbonate and kaolin, and FIG. 7 shows the absorption wavelength distribution of the coated paper. An absorption wavelength resulting from calcium carbonate exists at about 7100 nm, and absorption wavelengths resulting from kaolin and cellulose exist in the neighborhood of about 9700 nm, and the coated paper absorbs corresponding infrared input wavelengths.

In FIGS. 6 and 7, in addition to the absorption wavelength distributions of the recording materials, principal wavelengths of the above-described heaters are shown.

The wavelength of the infrared input radiation radiated from the light source of the infrared irradiating device 13 may preferably contain the absorption wavelength of the recording material 16. Specifically, when the absorption wavelength of the recording material 16 is λ, it is desirable that the wavelength region, in which the recording material 16 is irradiated with the infrared input radiation with the radiant energy density of not less than 10% of the maximum of the spectral radiant energy density in the far-infrared input region of the electromagnetic wave radiated by the infrared irradiating device 13, contains the absorption wavelength λ. The recording material 16 is capable of efficiently absorbing the radiant energy of the wavelength corresponding to the associated vibration absorption wavelength, so that the recording material 16 can be efficiently heated.

As shown in FIGS. 6 and 7, in the wavelength region of 6000 nm-11000 nm (i.e., not less than 6000 nm and not more than 11000 nm), the absorption wavelength resulting from cellulose and the absorption wavelengths resulting from calcium carbonate and kaolin are contained. Accordingly, it is desirable that the light source which radiates the electromagnetic wave having the spectral radiant energy density, in the wavelength region of 6000 nm-11000 nm (i.e., not less than 6000 nm and not more than 11000 nm), which is not less than 10% of the maximum of the spectral radiant energy density is used. For example, as the light source of the infrared irradiating device 13, by using the quartz tube heater, the ceramic heater (alumina) or the like, it is possible to more efficiently heat the recording material 16.

The infrared irradiating device 13 causes the infrared input radiation radiated from the filament to be reflected by a metal having a high reflectance in the infrared input region (range), so that the recording material 16 is irradiated with the reflected infrared input radiation. By radiating the infrared input radiation, molecular vibration of the recording material 16 is promoted, so that the temperature of the recording material 16 is increased. For example, a reflection plate formed of high-purity aluminium has a high reflectance in the infrared input region and is capable of reflecting the infrared input radiation with efficiency.

(Ultraviolet Irradiating Device and Infrared Irradiating Device)

Next, a relationship between an infrared input irradiation region and an ultraviolet irradiating region is shown in FIG. 9. FIG. 9 is a graph showing illuminance distributions of the ultraviolet irradiating device 12 and the infrared irradiating device 13 relative to the position with respect to the recording material feeding direction. In FIG. 9, the abscissa represents the position with respect to the recording material feeding direction, in which the position where the illuminance of the ultraviolet irradiating device 12 is a maximum (peak illuminance) is taken as a reference (center) P. The infrared input irradiation region is a region in which the illuminance is not less than 90% of the peak illuminance of the infrared irradiating device 13. The ultraviolet irradiation region is a region where the illuminance is not less than 30% of the peak illuminance of the ultraviolet irradiating device 12. The infrared irradiating device 13 has the infrared input irradiation region in a side upstream of the ultraviolet irradiation region with respect to the feeding direction of the recording material 16, and heats the recording material 16 to be fed to the ultraviolet irradiating device 12.

Incidentally, compared with the ultraviolet irradiation region, the infrared input irradiation region is broad but can be changed by changing a shape of the reflection mirror.

Further, the center of the infrared input irradiation region may also be positioned upstream of the center of the ultraviolet irradiation region with respect to the feeding direction of the recording material 16. In the following, a result of a study in the case in which the center of the infrared input irradiation is positioned upstream of the center of the ultraviolet irradiation region will be described.

Figures 10, 11:
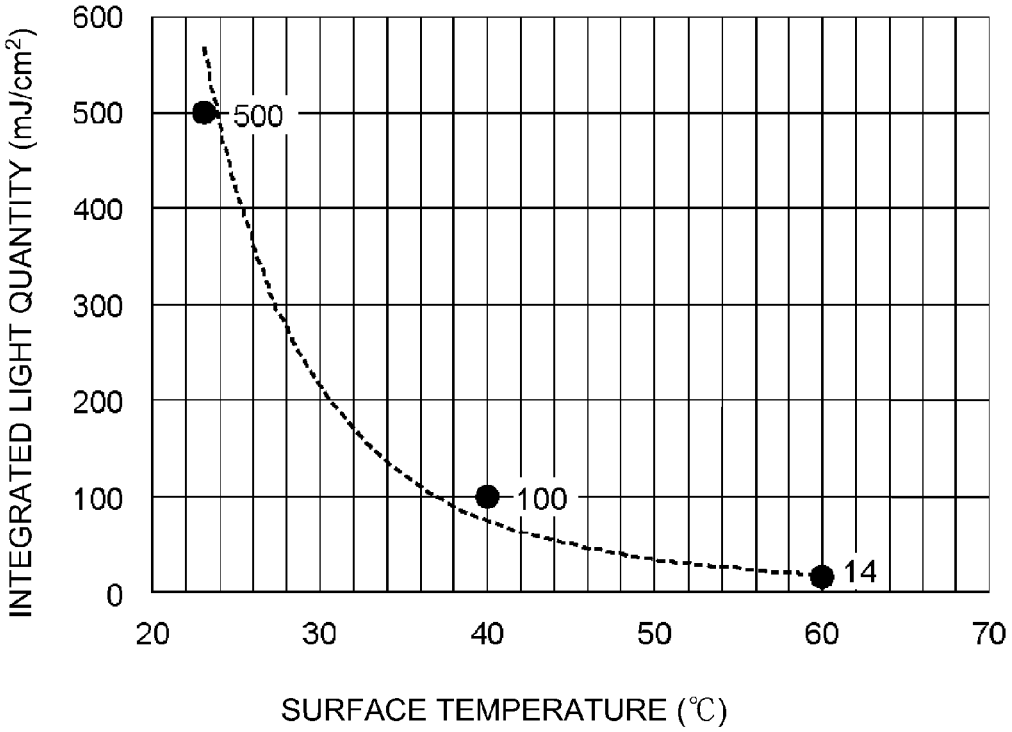
FIG. 10 is a graph showing an integrated light quantity necessary for curing relative to a surface temperature of a liquid developer.
FIG. 11 is a table showing an example of a difference in tack property depending on a temperature of the recording material and supplied electric power.

FIG. 10 is a graph showing an integrated light quantity ($mJ/cm^2$) necessary to cure the liquid developer 15 with respect to the surface temperature of the liquid developer 15 during the ultraviolet irradiation. The ultraviolet irradiating device 12 radiates the ultraviolet radiation with a maximum of the spectral illuminance falling in a range of 385±5 nm. Thus, when the surface temperature of the liquid developer 15 during the ultraviolet irradiation increases, the integrated light quantity ($mJ/cm^2$) necessary to cure the liquid developer 15 becomes small.

In the following, as the ultraviolet irradiating device 12, one providing the integrated light quantity of 100 $mJ/cm^2$ is used. In this case, in order to cure the liquid developer 15 by the ultraviolet irradiating device 12, the surface temperature of the liquid developer 15 during the ultraviolet irradiation may desirably be about 40° C.±5° C. (FIG. 10).

(Liquid Developer Used in this Embodiment)

The ultraviolet curable agent 21 of the liquid developer 15 used in this embodiment is a cationic polymerizable monomer. The cationic polymerizable monomer is a vinyl ether compound, and it is possible to use dichloropendadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

The ultraviolet curable agent (monomer) 21 of the liquid developer 15 in this embodiment is a mixture of about 10% (wt. %) of a monofunctional monomer (formula 1 below) having one vinyl ether group and about 90% (wt. %) of a difunctional monomer (formula 2 below) having two vinyl ether groups.

(formula 1)

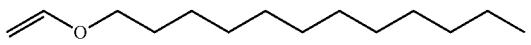

(formula 2)

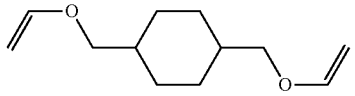

As the photopolymerization initiator, a compound (formula 3) shown below is mixed in an amount of 0.1%. By using this photopolymerization initiator, different from the case where an ionic photo-acid-generating agent, it is possible to obtain a high-resistance liquid developer 15 while achieving a good fixing property.

(formula 3)

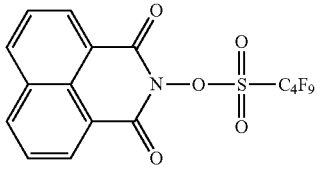

(Temperature of Recording Material and Output of Infrared Irradiating Device)

As described above, the surface temperature of the liquid developer 15 during the ultraviolet irradiation may desirably be about 40° C.±5° C., but the temperature of the liquid developer 15 is influenced by the temperature of the recording material 16.

After the image formed on an entire surface of the recording material 16 with the liquid developer 15 is fixed at the fixing portion 11, the surface of the recording material 16 was touched with a finger to check tack (tackiness), and the tack was evaluated in 3 ranks.

Rank 3: No tack is recognized.

Rank 2: Tack is slightly recognized.

Rank 1: A film is peeled off during touch with the finger or has not been cured.

According to study by the inventors of the present invention, it was confirmed that a desirable curing state (rank 3) was able to be obtained when the temperature of the recording material 16 at the ultraviolet irradiation position is not less than 40° C. In this embodiment, the ultraviolet irradiation position refers to a position in which the illuminance by the ultraviolet irradiating device 12 is a maximum (peak illuminance) in a positional distribution with respect to the feeding direction of the recording material 16.

The temperature of the recording material 16 varies depending on an ambient (environmental) temperature. For example, in the case in which the recording material 16 is accommodated in the cassette 25, it is assumed that the recording material 16 is adapted to the temperature in the cassette 25. For example, the recording material 16 just set in the cassette 25 is assumed to be adapted to an ambient temperature thereof in a place in which the recording material 16 is stored until just before being set in the cassette 25. In some cases, the recording material 16 of which a temperature is still low (e.g., about 5° C.) is used in the image formation. In such a case, there is a liability that the temperature of the liquid developer 15 is lowered by a cold recording material 16 and a degree of the curing of the liquid developer 15 by the ultraviolet radiation becomes insufficient.

Therefore, the infrared irradiating device 13 in this embodiment has a constitution in which the supplied electric power is variable, and an output thereof is controlled depending on the temperature of the recording material 16 fed to the ultraviolet irradiating device 12. The infrared irradiating device 13 is capable of increasing the temperature of the recording material 16 since an output (i.e., radiant energy) of the heater increases by increasing the supplied electric power. The CPU 50 as a controller controls the output of the infrared irradiating device 13 so that the temperature of the recording material 16 when the recording material 16 is irradiated with the ultraviolet radiation is not less than 40° C.

The output of the infrared irradiating device 13 necessary to obtain the rank 3 varies depending on the temperature of the recording material 16. FIG. 11 is a table showing an example of a difference in tack property depending on the temperature of the recording material (sheet) 16 and the supplied electric power. The temperatures of the recording material 16 shown in FIG. 11 are those before the image formation. At each of the temperatures, the generation or non-generation of the tack was checked when the supplied electric power to the infrared irradiating device 13 was changed, and the tack was evaluated in accordance with the above-described 3 ranks. In the case of FIG. 11, the recording material 16 is plain paper of 81 gsm in basis weight, and as the light source of the infrared irradiating device 13, the quartz tube heater was used.

In FIG. 11, data B shows a result of evaluation of the tack property after the fixing when the supplied electric power to the infrared irradiating device 13 is 100 W irrespective of the temperature of the recording material 16. The rank of the surface state of the recording material 16 after the ultraviolet irradiation was 1 or 2.

In FIG. 11, data A shows the supplied electric power to the infrared irradiating device 13 by which the rank 3 of the tack property after the fixing was obtained at each of the temperatures of the recording material 16. By increasing the supplied electric power to the infrared irradiating device 13, adhesiveness increases, so that a fixing property is improved. Further, with a decreasing temperature of the recording material 16 in the order of 20° C., 10° C. and 5° C., the supplied electric power (i.e., a necessary output of the infrared irradiating device 13) to the infrared irradiating device 13 necessary to obtain the rank 3 becomes larger.

FIG. 12 shows a result of confirmation as to a relationship among the kind, the basis weight and the temperature rise of the recording material 16. FIG. 12 is a table showing an example of a difference in temperature rise depending on the kind and the basis weight of the recording material 16. FIG. 12 shows the result of confirmation as to a degree of an increase in temperature of the recording material 16 by the image formation and the ultraviolet irradiation for each of plain papers of 81 gsm, 157 gsm and 300 gsm in basis weight and controls of 81 gsm, 157 gsm and 300 gsm in basis weight. As the light source of the infrared irradiating device 13, the quartz tube heater was used.

From these results, it would be considered that an amount of temperature rise of the recording material 16 is more influenced by the basis weight of the recording material 16 than by the kind of the recording material 16. Accordingly, the supplied electric power during the infrared input irradiation may preferably be determined depending on the basis weight of the recording material 16 subjected to the image formation.

Incidentally, the result shown in FIG. 12 is an example, and does not show that the temperature rise amount of the recording material 16 does not change at all. There is a liability that a difference in heating efficiency generates depending on the kind of the recording materials even when the recording materials have the same basis weight, depending on a relationship between a spectral distribution of radiant energy of the heater used as the light source of the infrared irradiating device 13 and an absorption wavelength of the recording material 16 used in the image formation. Accordingly, a constitution in which the electric power supplied to the infrared irradiating device 13 is changed depending on the kind of the recording material 16 may also be employed.

First, in the case where the temperature of the image holding member 1 during the image formation is 40° C., the temperature of the recording material 16 immediately after the image formation was, compared with the temperature of the recording material 16 before the image formation, +9° C. at the basis weight of 81 gsm, +5° C. at the basis weight of 157 gsm, and +3° C. at the basis weight 300 gsm. Further, in the case where the electric power of 100 W was supplied to the infrared irradiating device 3, the temperature of the recording material was +9° C. at the basis weight of 81 gsm, +5° C. at the basis weight of 157 gsm, and +3° C. at the basis weight of 300 gsm. On the other hand, in the case where the electric power of 600 W was supplied to the infrared irradiating device 13, the temperature of the recording material was +44° C. at the basis weight of 81 gsm, +22° C. at the basis weight of 157 gsm, and +15° C. at the basis weight of 300 gsm.

Incidentally, as one of methods of sufficiently curing the liquid developer 15 even in the case of a low-temperature recording material, a constitution in which the infrared input radiation having an output capable of heating even the lowest-temperature recording material 16, among assumed recording materials to 40° C. or more, irrespective of the temperature of the recording material, would be considered. For example, a constitution such that the recording material 16 is irradiated with the infrared input radiation with the supplied electric power of 600 W irrespective of the temperature of the recording material 16 would be considered. However, when such a constitution is employed, not only the low-temperature recording material 16 but also a high-temperature recording material 16 (e.g., 30° C.), such that the liquid developer 15 can be sufficiently cured even with a lower supplied electric power, are irradiated with the infrared input radiation with the supplied electric power of 600 W. For that reason, electric power consumption by the infrared irradiating device 13 increases. When the output of the infrared irradiating device 13 is excessively large, there is a liability that the recording material 16 is excessively heated. When the recording material 16 is excessively heated, water in the recording material 16 vaporizes, and fibers of the recording material 16 generate hydrogen bond and deform. As a result, there is a liability that deformation of the recording material 16 generates.

Therefore, the CPU 50 as the controller in this embodiment controls, depending on the temperature of the recording material 16 fed to the infrared irradiating device 13, the output of the infrared irradiating device 13 so that the temperature of the recording material 16 when the recording material 16 is irradiated with the ultraviolet radiation falls within a target temperature range. As a result, irrespective of the temperature state of the recording material (recording material) 16 fed to the ultraviolet irradiating device 12, it is possible to suppress a lowering in quality of a resultant product due to improper curing of the liquid developer 15 and the deformation of the recording material 16. Further, it is possible to suppress an increase in electric power consumption by the infrared irradiating device 13.

The target temperature range is not less than 40° C. and less than 70° C. A lower limit of the target temperature is the temperature at which the rank 3 can be obtained in the evaluation of the tack property as described above, and an upper limit of the target temperature is a temperature at which the deformation of the recording material 16 does not readily generate. The value of the target temperature range is an example, and is not limited thereto. The target temperature value may only be required to be appropriately determined within a temperature range such that the required rank of the tack property is satisfied and the deformation of the recording material 16 does not readily generate.

(Control Flow)

Figure 13:
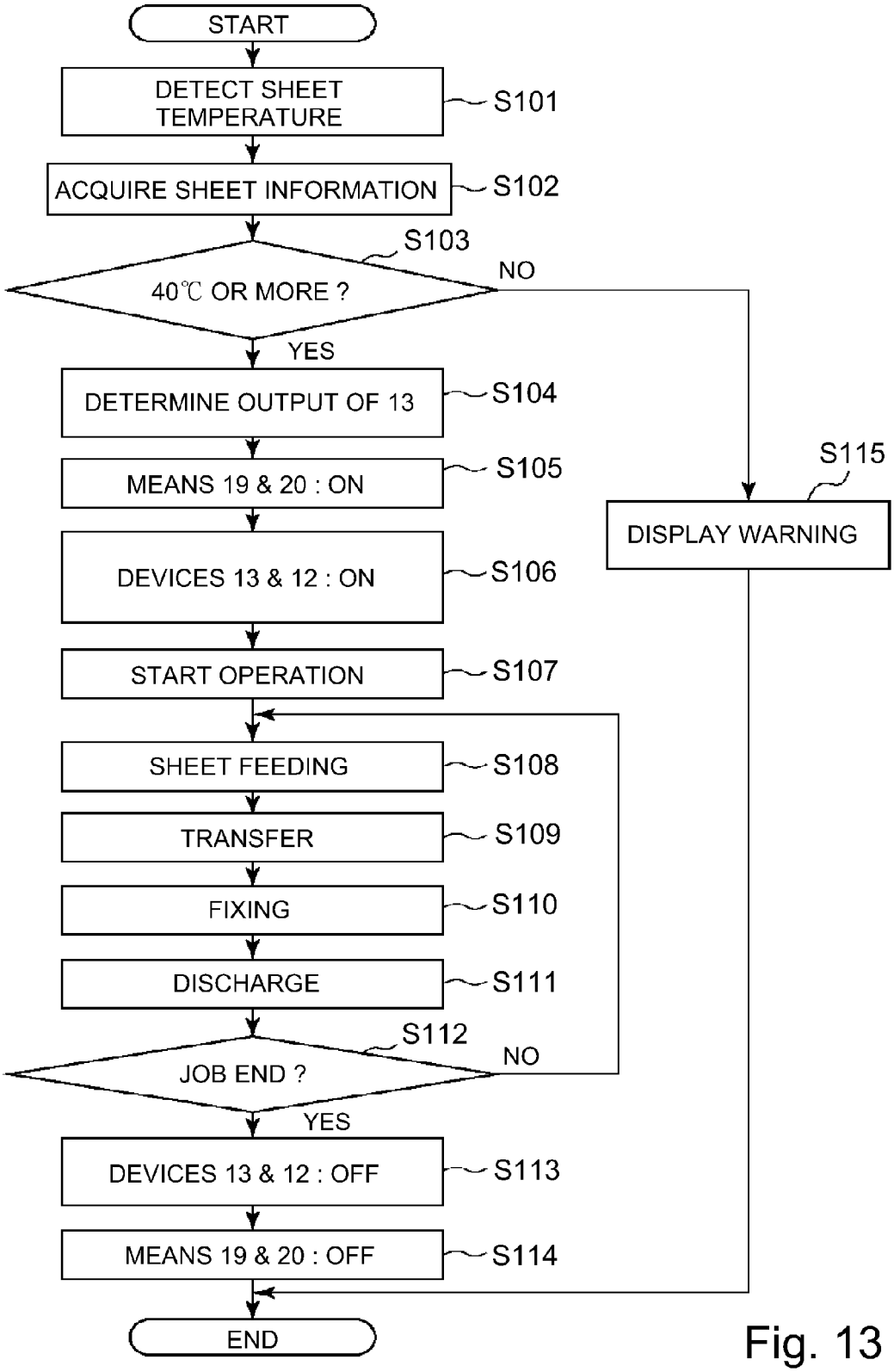
FIG. 13 is a flowchart showing control of image formation.

With reference to FIG. 13, an example of each of an operation of the infrared irradiating device 13 and an image forming operation in this embodiment will be described. FIG. 13 is a flowchart showing control of the image formation. Control shown in flowcharts in this embodiment and other embodiments (FIGS. 13, 14 and 17) is carried out by execution of control programs stored in a storing means, incorporated in the CPU 50, by the CPU 50 functioning as an executing portion (controller).

In this embodiment, the image forming apparatus 100 is in a state capable of executing an image forming process after a power source is turned on and the temperature of the image holding member 1 reaches 40° C. In the state capable of executing the image forming process, when the image forming apparatus 100 receives an image formation instruction (print job), the image forming apparatus 100 starts the image forming operation. Incidentally, a constitution in which the image forming apparatus 100 can receive the print job before the temperature of the image holding member 1 becomes 40° C. may also be employed. In this constitution, in the case where the image forming apparatus 100 receives the print job before the temperature of the image holding member 1 becomes 40° C., the image forming apparatus 100 starts the image forming operation after the temperature of the image holding member 1 reaches 40° C.

When the image forming operation is started, first, the recording material temperature detecting means 3 provided at the recording material feeding portion 9 detects the temperature of the recording material 16 before image formation. The CPU 50 acquires the temperature detected by the recording material temperature detecting means 3 (S101). Measurement accuracy is ±3° C.

The CPU 50 acquires information on the recording material 16 used in the image formation through the operating panel 51 (S102). In this embodiment, the CPU 50 acquires information on the kind and the basis weight of the recording material 16 used in the image formation. The information on the recording material 16 used in the image formation is inputted through the operating panel 51 by an operator. Incidentally, a constitution in which the information is inputted together with receipt of the print job may also be employed.

The CPU 50 discriminates whether or not the temperature of the recording material 16 at the ultraviolet irradiation position can be made not less than 40° C. in the case where the output of the infrared irradiating device 13 is a maximum (S103). Here, the CPU 50 makes the discrimination on the basis of the temperature of the recording material 16 detected by the recording material temperature detecting means 3 and the information on the kind and the basis weight of the recording material 16 acquired through the operating panel 51. For example, in the case in which the output of the infrared irradiating device 13 is the maximum, the information on the temperature, the kind and the basis weight capable of making the temperature of the recording material 16 at the ultraviolet irradiation position not less than 40° C. is stored in the storing means in the CPU 50 in advance, and then the CPU 50 makes the discrimination with reference to the information.

In the case where the CPU 50 discriminates in S103 that the temperature of the recording material 16 at the ultraviolet irradiation position can be made not less than 40° C., the CPU 50 determines an output of the infrared irradiating device 13 for keeping the temperature of the recording material 16 at the ultraviolet irradiation position within the target temperature range (S104). In the storing means incorporated in the CPU 50, information (correspondence information) showing correspondence of electric power to be supplied to the infrared irradiating device 13 with the temperature of the recording material 16 is stored. The CPU 50 determines the electric power supplied to the infrared irradiating device 13 on the basis of the temperature of the recording material 16 detected by the recording material temperature detecting means 3, the information on the kind and the basis weight of the recording material 16 acquired through the operating panel 51, and the correspondence information stored in the storing means.

FIG. 15 is a table showing an example of setting of the supplied electric power depending on the temperature of the recording material. For example, correspondence information as shown in FIG. 15 is held (stored) in the storing means for each of the kinds and the basis weights of the recording materials 16. Values shown in FIG. 15 are an example and are not limited thereto. For example, FIG. 15 shows an example where the temperature of the recording material 16 is increased with an increment of 5° C., but a constitution in which the supplied electric power is set with an increment of 1° C. may also be employed. Further, the present invention is not limited to the constitution in which the table as shown in FIG. 15 is held, but may also employ a constitution based on a function or program for determining the supplied electric power.

The target temperature range is set in advance as a range (e.g., not less than 40° C. and less than 70° C.) in which the liquid developer 15 is sufficiently cured and the deformation of the recording material 16 does not generate. Incidentally, in order to suppress the electric power consumption by the infrared irradiating device 13, a constitution in which electric power of a smaller value is supplied by setting, as the target temperature, a low temperature (e.g., not less than 40° C. and less than 45° C.) within a temperature range in which at least the liquid developer 15 is sufficiently cured may also be employed.

For example, in the case where the image is formed on the recording material 16 of 81 gsm in basis weight, when the temperature of the recording material 16 before image formation is 22° C., in order to make the temperature of the recording material 16 at the ultraviolet irradiation position not less than 40° C., the output of the infrared irradiating device 13 is required to be at least 100 W. However, the supplied electric power is set so as not to provide the temperature of less than 40° C. even when an error of temperature measurement or the like is taken into consideration. For example, in this case, in the constitution in this embodiment, 120 W (which is the supplied electric power providing the temperature of about 43° C. in study by the present inventor) is supplied.

In the flowchart of FIG. 13, when the output of the infrared irradiating device 13 is determined, the CPU 50 turns on the driving means 19 for the image forming portion and the driving means 20 for the feeding belt 14 (S105), and turns on the infrared irradiating device 13 and the ultraviolet irradiating device 12 (S106). In order to prevent damage on the feeding belt 14 caused by heating the same region of the feeding belt 14, in a state in which the feeding belt 14 is rotated by the driving means 20 of the fixing portion, it is desirable that the infrared irradiating device 13 and the ultraviolet irradiating device 12 are turned on. The infrared irradiating device 13 radiates the infrared input radiation with an output determined in the process of S104. That is, the CPU 50 supplies electric power such that the output of the infrared irradiating device 13 is the output determined in the process of S104, and turns on the infrared irradiating device 13.

Thereafter, the CPU 50 starts a recording material feeding operation by the recording material feeding portion 9 (S107). Processes of S108-S111 show a flow of the image forming process on one sheet of the recording material 16. The CPU 50 causes the recording material feeding portion 9 to feed the recording material 16 (S108) and causes the transfer means 4 to transfer the image of the liquid developer 15 from the image holding member 1 onto the recording material 16 (S109). Then, the CPU 50 causes the fixing portion 11 to fix the image on the recording material 16 by causing the ultraviolet irradiating device 12 to irradiate the recording material 16, with the ultraviolet radiation, of which temperature falls within the target temperature by the irradiation with the infrared input radiation at the output determined by the process of S104 (S110). Then, the CPU 50 discharges the recording material 16, on which the image is fixed at the fixing portion 11, to an outside of the image forming apparatus, such as a paper discharge tray (S111). The CPU 50 repeats the processes of S108-S112 until the print job is ended, and when the print job is ended, the process goes to S113 (S112).

The CPU 50 turns off the driving means 19 for the image forming portion 1 and the driving means 20 for the feeding belt 14 after the outputs of the infrared irradiating device 13 and the ultraviolet irradiating device 12 are turned off in S113 (S114). Then, the image forming operation is ended.

Further, in S103, even at the maximum output of the infrared irradiating device 13, in the case where the CPU 50 discriminates that the temperature of the recording material 16 at the ultraviolet irradiation position cannot be made not less than 40° C., the CPU 50 displays, at the operating panel 51, a warning to the effect that image formation cannot be carried out (S115). Incidentally, the method of notifying the operator of the warning to the effect that image formation cannot be carried out is not limited thereto, but may also be a voice or the like. Then, the CPU 50 ends the image forming operation without starting the feeding of the recording material 16 by the recording material feeding portion 9. That is, the CPU (prohibiting portion) 50 executes a process of prohibiting the feeding of the recording material 16 by the recording material feeding portion 9. As a result, for example, in the case where the recording material 16 is low in temperature more than an assumed amount (i.e., in the case where the temperature detected in S101 is not more than a predetermined temperature), it is possible to employ a constitution in which the image formation on the recording material 16, which cannot be sufficiently heated by the infrared irradiating device 13, is not performed. Accordingly, it is possible to eliminate a liability that the resultant product on which the degree of the curing of the liquid developer 15 is insufficient is outputted.

In the control shown in FIG. 13, the constitution in which the output of the infrared irradiating device 13 is determined on the basis of the kind and the basis weight of the recording material 16 in addition to the temperature of the recording material 16 before the image formation is employed (S104), but the following constitution may also be employed. For example, a constitution in which the output of the infrared irradiating device 13 is determined on the basis of the temperature of the recording material 16 before the image formation and either one of the kind and the basis weight of the recording material 16, not both of the kind and the basis weight of the recording material 16, may also be employed. Further, a constitution in which the output of the infrared irradiating device 13 is determined depending on the temperature of the recording material 16 before the image formation without being based on the kind and the basis weight of the recording material 16 may also be employed. This is also true for S103 in FIG. 13.

In the control shown in FIG. 13, in S103, the constitution, in which, in the case in which the output of the infrared irradiating device 13 is a maximum, whether or not the temperature of the recording material 16 at the ultraviolet irradiation position can be made not less than 40° C. is discriminated, is employed. In addition, a constitution, in which whether or not the recording material temperature satisfies the upper limit of the target temperature is discriminated, may also be employed. That is, a constitution, in which whether or not the temperature of the recording material 16 at the ultraviolet irradiation position can be made to be a value falling within the target temperature range is discriminated by controlling the output of the infrared irradiating device 13, may also be employed. In the case in which the temperature of the recording material 16 at the ultraviolet irradiation position can be made not less than 40° C. at the maximum output of the infrared irradiating device 13 and is less than 70° C. at a minimum output of the infrared irradiating device 13, the CPU 50 discriminates as being "YES". In this case, the minimum output of the infrared irradiating device 13 includes an "OFF" state of the infrared irradiating device 13.

Further, a constitution in which during execution of the image forming process, the output of the infrared irradiating device 13 is changed depending on a change in temperature, of the recording material 16 before the image formation, detected by the recording material temperature detecting means 3 may also be employed. Specifically, the CPU 50 executes a flow shown in FIG. 14 in parallel to execution of the processes of S107-S112 or in a period after the CPU 50 discriminates as being "NO" in S112 and before the feeding of the recording material 16 is made in S108.

Figure 14:
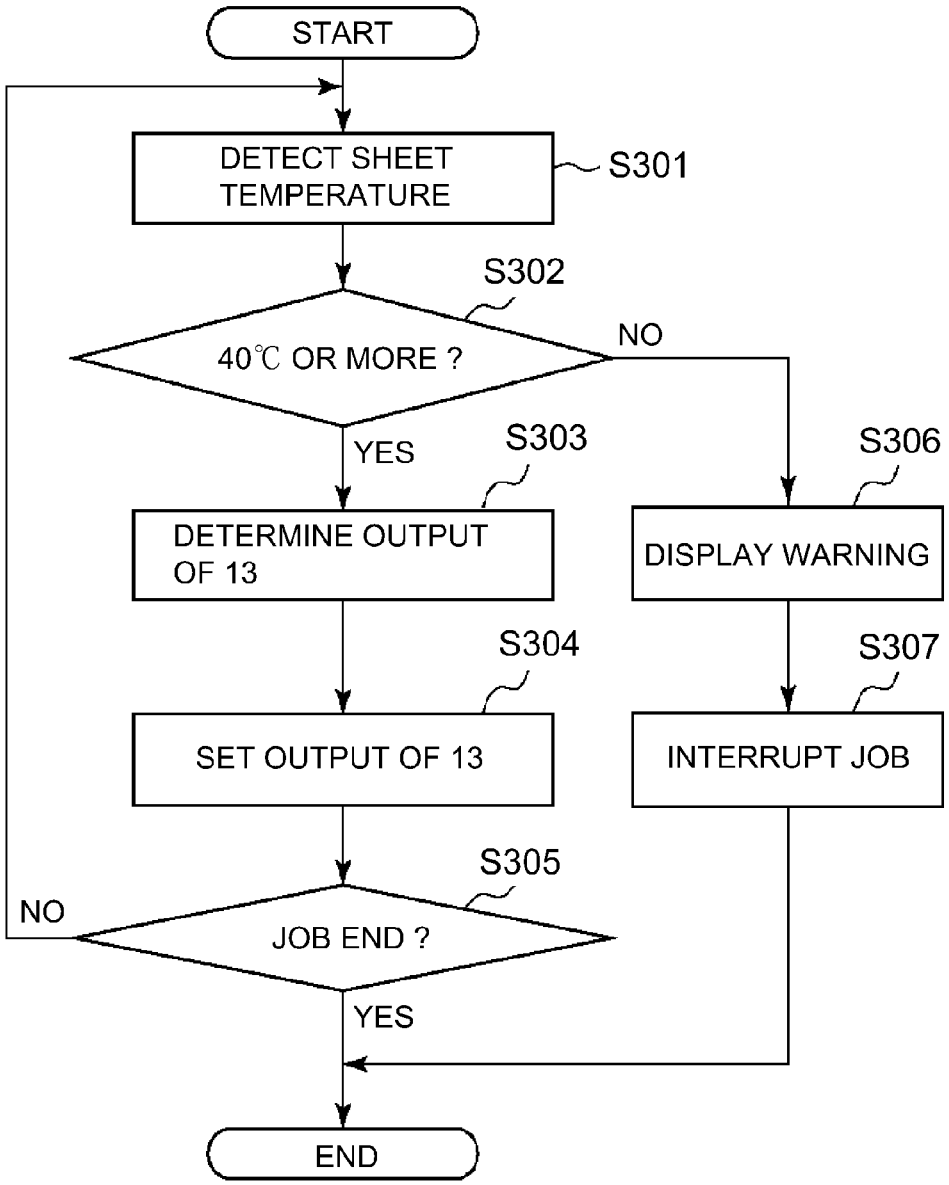
FIG. 14 is a flowchart showing control of the image formation.

FIG. 14 is a flowchart showing control as to the image formation. The CPU 50 acquires the temperature, of the recording material 16 before the image formation, detected by the recording material temperature detecting means 3 (S301), and discriminates whether or not the temperature of the recording material 16 at the ultraviolet irradiation position can be made not less than 40° C. in the case where the output of the infrared irradiating device 13 is a maximum (S302). In S302, the CPU 50 makes the discrimination on the basis of the temperature of the recording material 16 and the information on the kind and the basis weight of the recording material 16. Incidentally, the information on the kind and the basis weight of the recording material 16 has already been acquired in S102 of FIG. 13. Details of S302 are similar to those in S103 (FIG. 13), and therefore will be omitted from this description.

In the case where the CPU 50 discriminates in S302 at the maximum output that the temperature of the recording material 16 at the ultraviolet irradiation position can be made not less than 40° C., the CPU 50 determines an output of the infrared irradiating device 13 similarly as in S104 of FIG. 13 (S303).

The output of the infrared irradiating device 13 is set at the determined output (S304). Specifically, the CPU 50 supplies the electric power so that the output of the infrared irradiating device 13 is the output determined by the process of S303. As a result, even in the case where the temperature of the recording material 16 before the image formation is changed from that during the detection in S101 of FIG. 13 (i.e., during the start of the print job), the temperature of the recording material 16 at the ultraviolet irradiation position can be controlled within the target temperature range.

The CPU 50 executes the flow shown in FIG. 14 until the print job is ended (S305).

As a result, even in the case where the temperature of the recording material 16 before the image formation is changed during the execution of the image forming process, the temperature of the recording material 16 at the ultraviolet irradiation position can be controlled within the target temperature range.

In S302, in the case in which the CPU 50 discriminates that the temperature of the recording material 16 at the ultraviolet irradiation position cannot be made not less than 40° C. at the maximum output of the infrared irradiating device 13, the CPU 50 displays a warning similarly as in S115 (FIG. 13) (S306), and interrupts the print job (S307).

As described above, irrespective of the temperature state of the recording material (recording material) 16 fed to the ultraviolet irradiating device 12, it is possible to suppress a lowering in quality of the resultant product due to improper curing of the liquid developer 15 and the deformation of the recording material 16.

[Embodiment 2]

In Embodiment 1, a constitution in which the recording material temperature detecting means 3 provided at the recording material feeding portion 9 directly measured the temperature of the recording material 16 used in the image formation and the temperature of the recording material 16 was detected was employed.

In Embodiment 2, instead of directly detecting the temperature of the recording material 16, a constitution in which the temperature of the recording material 16 is detected on the basis of a detection result of an external temperature detecting means 6 will be described. In this embodiment, constituent elements similar to those in Embodiment 1 are represented by the same reference numerals or symbols and will be appropriately omitted from detailed description.

Figure 16:
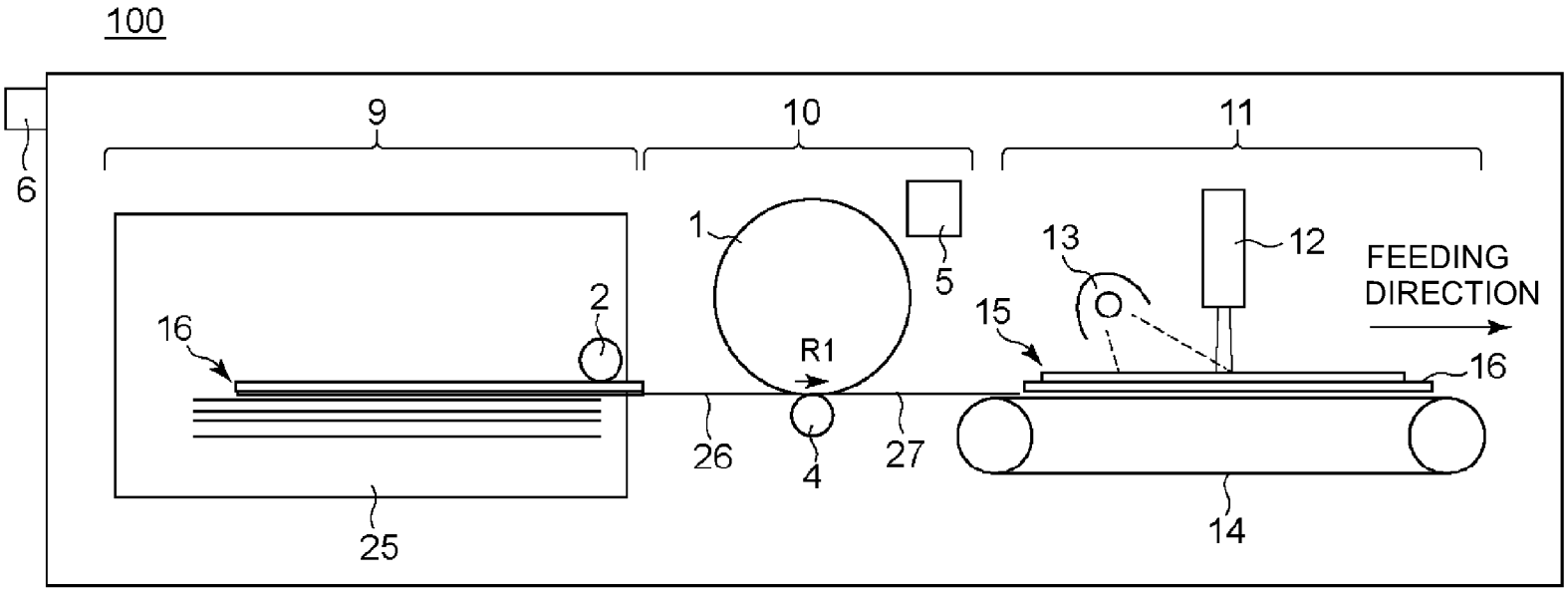
FIG. 16 is a schematic view showing a general structure of an image forming apparatus.

FIG. 16 is a schematic view showing a general structure of an image forming apparatus in this embodiment. A difference from Embodiment 1 is that the external temperature detecting means 6 is provided in place of the recording material temperature detecting means 3.

The external temperature detecting means 6 is a temperature sensor for measuring an ambient temperature of the image forming apparatus 100. In this embodiment, a thermistor is used as the external temperature detecting means 6, but a constitution, in which a platinum resistance temperature sensor, a thermocouple, or the like is used, may also be used. The external temperature detecting means 6 is provided outside a main assembly (frame) of the image forming apparatus 100. Specifically, the external temperature detecting means 6 may desirably be provided in a place which is an outer wall of the main assembly (frame) of the image forming apparatus 100 and where the external temperature detecting means 6 is not readily affected by a heat source of the image forming apparatus 100. As the heat source of the image forming apparatus 100, for example, circuit boards for the infrared irradiating device 13, the ultraviolet irradiating device 12, the CPU 50 and the like are used.

It is expected that the recording material 16 just set in the cassette 25 is adapted to an ambient temperature at which the recording material 16 is stored until just before being set in the cassette 25. In the case in which the recording material 16 is stored as a supplementary recording material 16 at a periphery of the image forming apparatus 100, the temperature of the recording material 16 just set in the cassette 25 is also an external temperature.

In the case in which the cassette 25 is not provided with a heater, the temperature in the cassette 25 is adapted to the ambient temperature of the image forming apparatus 100. Even if the recording material 16 is stored in a place different from a peripheral place of the image forming apparatus 100, in most cases, in a relatively short time (usually in about 10 min.) from the setting in the cassette 25, the temperature of the recording material 16 is almost equal to the external temperature.

Accordingly, the external temperature detected by the external temperature detecting means 6 can be regarded as the temperature of the recording material 16 before the image formation. That is, the external temperature detecting means 6 detects the external temperature as information corresponding to the temperature of the recording material 16 to be fed to the infrared irradiating device 13 and functions as a detecting portion for detecting the temperature of the recording material 16 to be fed to the infrared irradiating device 13.

The CPU 50 as the controller detects and controls, on the basis of the external temperature detected by the external temperature detecting means 6, the output of the infrared irradiating device 13 so that the temperature of the recording material 16 when the recording material 16 is irradiated with the ultraviolet radiation falls within a target temperature range. As a result, irrespective of the temperature state of the recording material (recording material) 16 fed to the ultraviolet irradiating device 12, it is possible to suppress a lowering in quality of a resultant product due to improper curing of the liquid developer 15 and the deformation of the recording material 16.

Incidentally, in operation, the recording material 16 may preferably be subjected to a process (temperature adjusting process) in which the recording material 16 is placed for a predetermined time in the same environment as the image forming apparatus 100.

Figure 17:
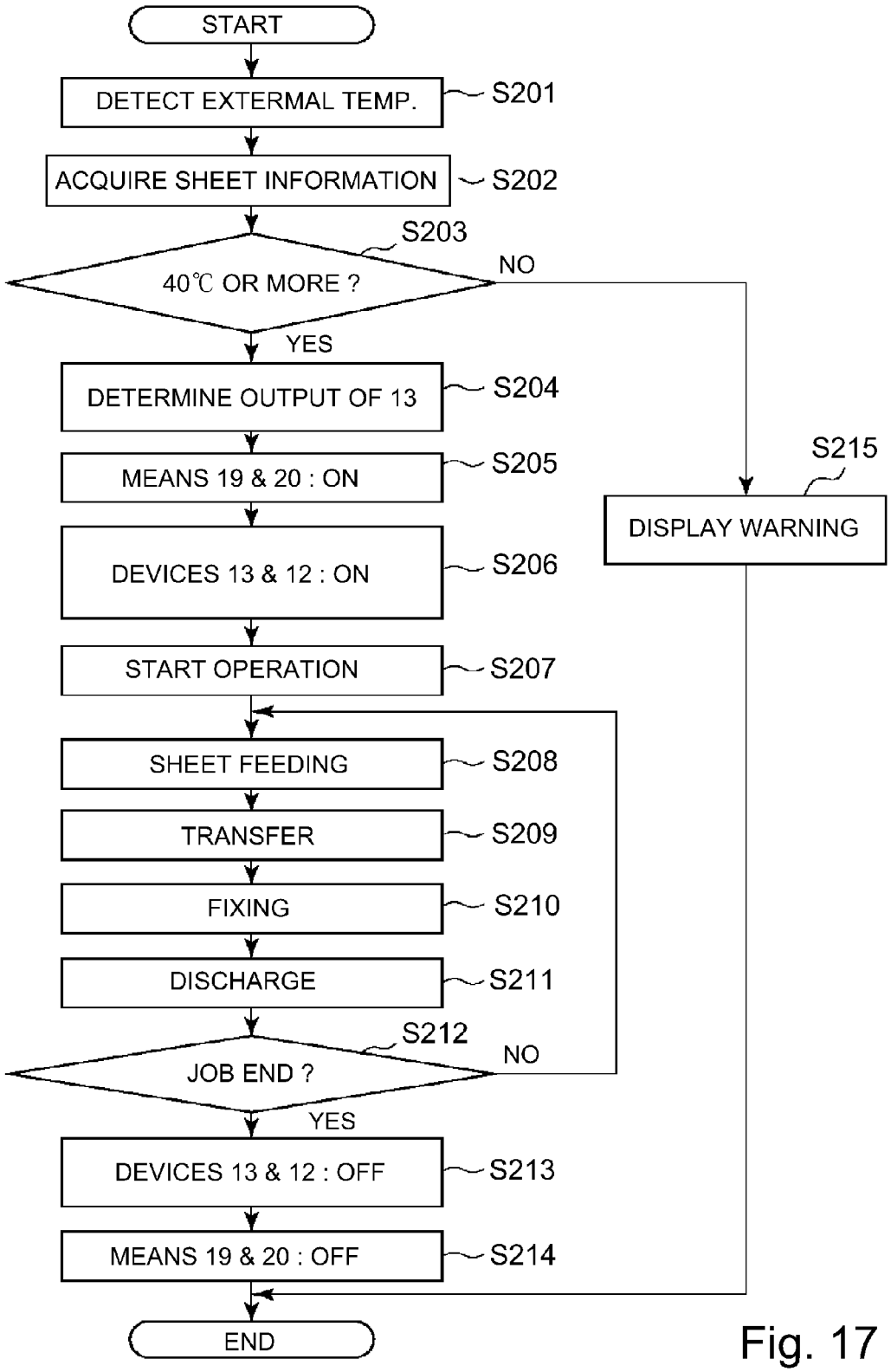
FIG. 17 is a flowchart showing control of image formation.

With reference to FIG. 17, an example of each of an operation of the infrared irradiating device 13 and an image forming operation in this embodiment will be described. FIG. 17 is a flowchart showing control of the image formation.

When the image forming operation is started, first, the external temperature detecting means 6 detects the external temperature. Measurement accuracy is ±0.3° C. The CPU 50 acquires the temperature detected by the external temperature detecting means 6 (S201).

A process of S202 is similar to that of S102 of FIG. 13 and therefore will be omitted from description.

The CPU 50 discriminates whether or not the temperature of the recording material 16 at the ultraviolet irradiation position can be made not less than 40° C. at the maximum output of the infrared irradiating device 13 on the basis of the external temperature detected by the external temperature detecting means 6 and the information on the kind and the basis weight of the recording material 16 (S203). The information on the kind and the basis weight of the recording material 16 is acquired in S202. For example, in the case in which the output of the infrared irradiating device 13 is a maximum, the information on the temperature, the kind and the basis weight capable of making the temperature of the recording material 16 at the ultraviolet irradiation position not less than 40° C. is stored in the storing means in the CPU 50 in advance, and then the CPU 50 makes the discrimination with reference to the information.

In the case in which the CPU 50 discriminates in S203 that the temperature of the recording material 16 at the ultraviolet irradiation position can be made not less than 40° C., the CPU 50 determines an output of the infrared irradiating device 13 for keeping the temperature of the recording material 16 at the ultraviolet irradiation position within the target temperature range (S204). In the storing means incorporated in the CPU 50, information (correspondence information) showing correspondence of electric power to be supplied to the infrared irradiating device 13 with the external temperature detected by the external temperature detecting means 6 as the information corresponding to the temperature of the recording material 16 is stored. The CPU 50 determines the electric power supplied to the infrared irradiating device 13 on the basis of the external temperature detected by the external temperature detecting means 6, the information on the kind and the basis weight of the recording material 16 acquired through the operating panel 51, and the correspondence information stored in the storing means.

Processes of S205-S215 are similar to those of S105-S115 of FIG. 13, respectively, and therefore will be omitted from description. Incidentally, the output of the infrared irradiating device 13 in S206 is the output determined in S204.

In S203, in the case in which the CPU 50 discriminates that the temperature of the recording material 16 at the ultraviolet irradiation position cannot be made not less than 40° C. even at the maximum output of the infrared irradiating device 13, the CPU 50 displays, at the operating panel 51, a warning to the effect that the image formation cannot be carried out (S215), and ends the image forming operation.

[Embodiment 3]

In Embodiments 1 and 2, the infrared irradiating device 13 is provided downstream of the image holding member 1 and upstream of the ultraviolet irradiating device 12 with respect to the feeding direction of the recording material 16, and the surface of the recording material 16, on which the image which is not irradiated with the ultraviolet radiation is formed, is irradiated with the infrared input radiation. As a result, the infrared irradiating device 13 not only heats the recording material 16 but also heats the liquid developer 15 on the recording material 16. That is, a constitution in which the infrared irradiating device 13 has both of the function as a heating portion for heating the recording material 16 fed to the ultraviolet irradiating device 12 and the function as a heating portion for heating the unfixed image with the liquid developer 15 on the recording material 16 is employed. In this embodiment, this constitution will be specifically described.

In the image forming apparatus 100 in FIG. 1, the infrared irradiating device 13 functions not only as a heating means of the recording material 16 but also as a heating means of the liquid developer 15. For that reason, as the liquid developer 15, a liquid developer having an absorption wavelength in the far-infrared input region (1000 nm-15000 nm) is used. Further, a constitution in which the irradiating device 13 is provided downstream of the image holding member 1 with respect to the feeding direction of the recording material 16 similarly as in Embodiments 1 and 2 is employed.

The liquid developer 15 in this embodiment is similar to those in Embodiments 1 and 2, and the cationic polymerizable monomer as the ultraviolet curable agent is the vinyl ether compound. A detailed constitution was described in Embodiment 1 and therefore will be omitted.

Figure 18:
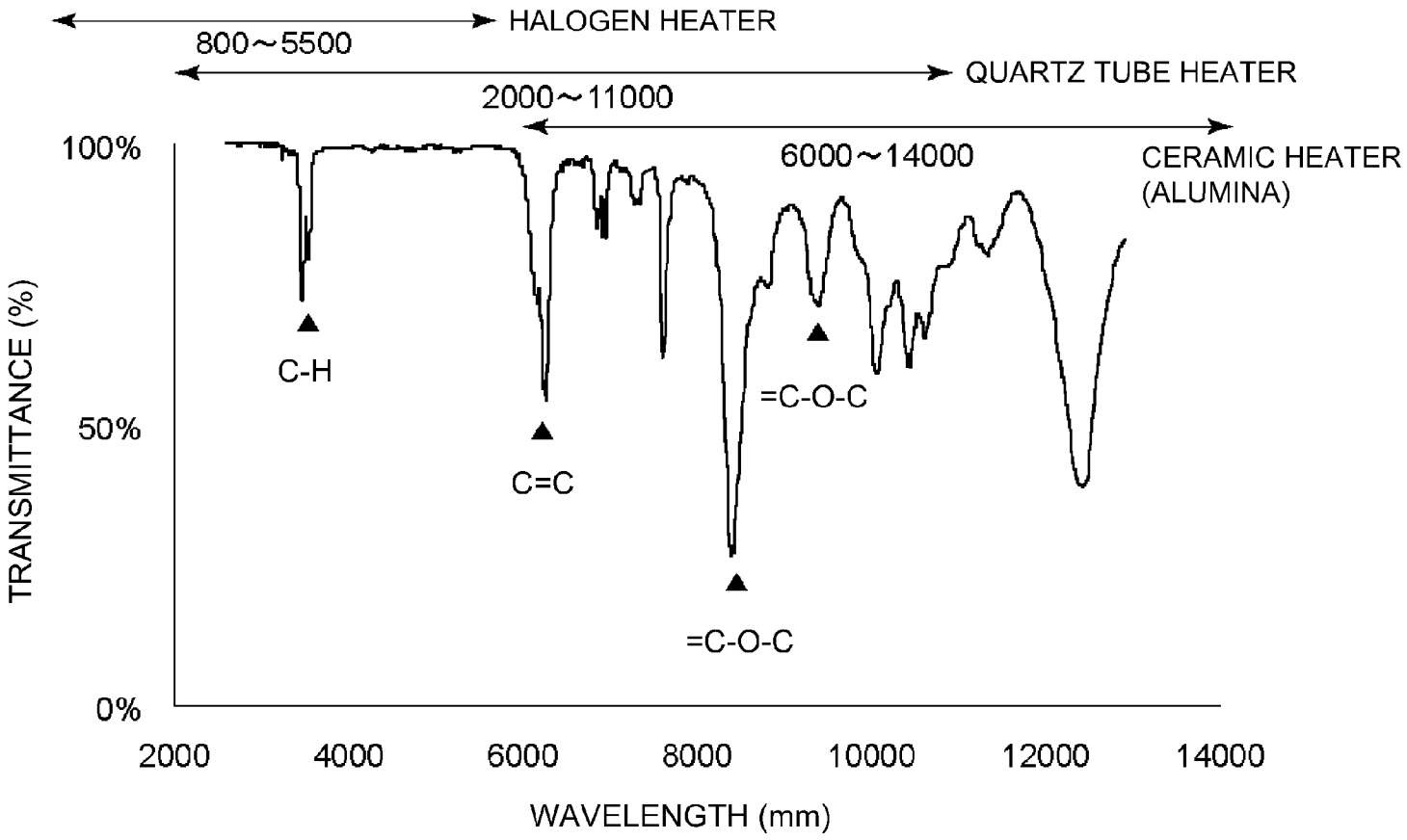
FIG. 18 is a graph showing an absorption wavelength distribution of a liquid developer.

FIG. 18 is a graph showing an absorption wavelength distribution of the liquid developer, and shows the absorption wavelength distribution of the ultraviolet curable agent 21 contained in the liquid developer 15. For example, C═C bond absorbs the infrared input radiation of 6200 nm in wavelength, and C—O—C bond absorbs the infrared input radiation of 8350 nm and 9350 nm in wavelength.

FIG. 18 shows principal wavelengths of the representative heaters in addition to the absorption wavelength distribution of the liquid developer 15 in this embodiment. Here, the absorption wavelength of the liquid developer 15 is contained in the wavelength of the electromagnetic wave in the far-infrared input region where the infrared irradiating device 13 radiates the electromagnetic wave. Accordingly, the infrared irradiating device 13 as the heating portion for heating the recording material 16 can heat not only the recording material 16 but also the liquid developer 15 on the recording material 16. Specifically, it is desirable that the absorption wavelength of the liquid developer 15 is contained in a wavelength region where the spectral radiant energy density is not less than 10% of the maximum of the spectral radiant energy density in the far-infrared input region where the infrared irradiating device 13 radiates the electromagnetic wave.

As shown in FIG. 18, in a wavelength region of 6000 nm-11000 nm (i.e., 6000 nm or more and 11000 nm or less), an absorption wavelength resulting from the C═C bond of the liquid developer 15 and an absorption wavelength resulting from the C—O—C bond of the liquid developer 15 are contained. Here, the wavelength region of 6000 nm-11000 nm is a wavelength (region) at which the recording material 16 can be efficiently heated as shown in Embodiment 1. Accordingly, as in the liquid developer 15 in this embodiment, by using the vinyl ether compound as the ultraviolet curable agent 21, not only the recording material 16 but also the liquid developer 15 on the recording material 16 can be efficiently heated. As a result, the temperature of the liquid developer 15 increases. A curing reaction is accelerated, so that it is possible to suppress a light quantity of the ultraviolet irradiating device 12 necessary to cure the liquid developer 15 and it is possible to suppress an increase in consumed energy of the ultraviolet irradiating device 12.

Further, a single infrared irradiating device 13 can perform both of the functions as the heating means of the liquid developer 15 and the heating means of the recording material 16. Accordingly, compared with the case where the heating means of the liquid developer 15 and the heating means of the recording material 16 are separately provided from each other, a cost for these heating means can be suppressed to about half. Further, it is possible to suppress a space of the heating portion for preventing the improper fixing.

As the light source of the infrared irradiating device 13, it is desirable that the light source which radiates the electromagnetic wave having the spectral radiant energy density, in the wavelength region of 6000 nm-11000 nm (i.e., not less than 6000 nm and not more than 11000 nm), which is not less than 10% of the maximum of the spectral radiant energy density is used. For example, as the light source of the infrared irradiating device 13, by using the quartz tube heater, the ceramic heater (alumina) or the like.

[Embodiment 4]

In Embodiments 1-3, a constitution in which the infrared irradiating device 13 as the heating portion for heating the recording material 16 before the ultraviolet irradiation is provided downstream of the image holding member 1 with respect to the feeding direction of the recording material 16 was employed. However, a constitution in which the heating portion for heating the recording material 16 before the ultraviolet irradiation is provided downstream of the recording material feeding portion 9 and upstream of the image holding member 1 with respect to the feeding direction of the recording material 16 may also be employed.

Figure 19:
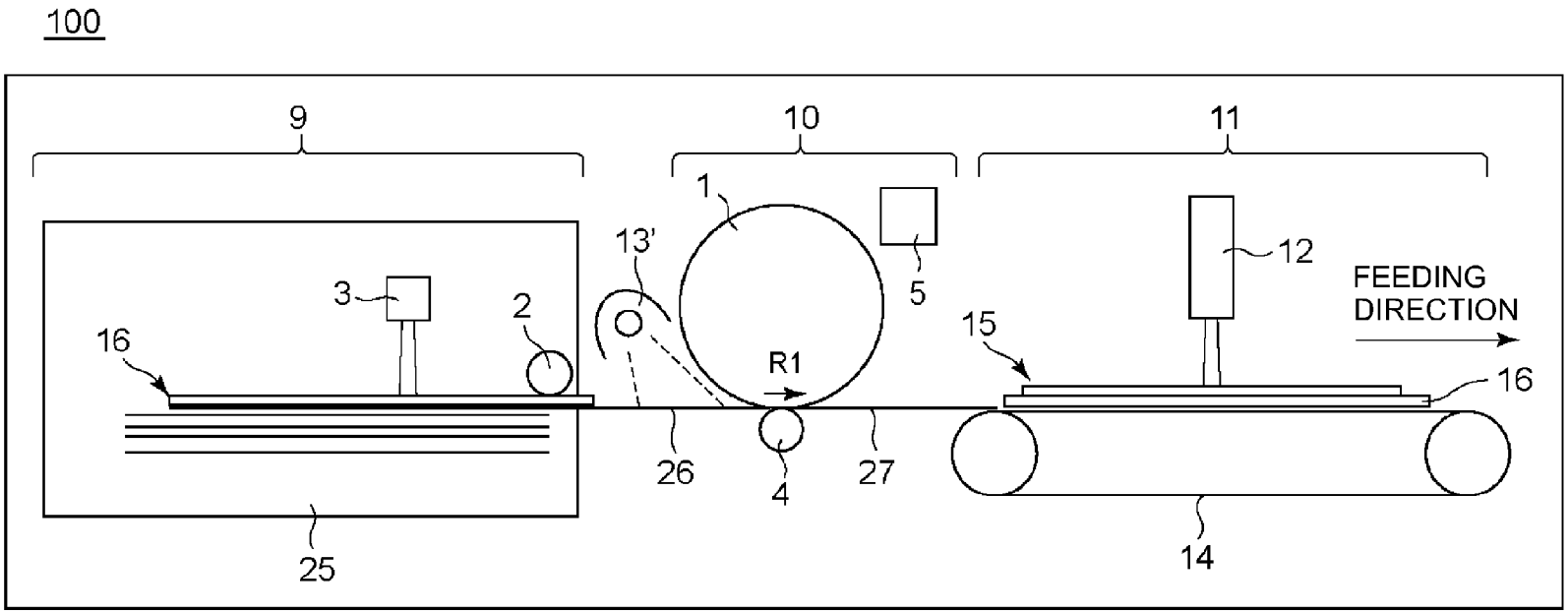
FIG. 19 is a schematic view showing general structure of an image forming apparatus.
Figure 20:
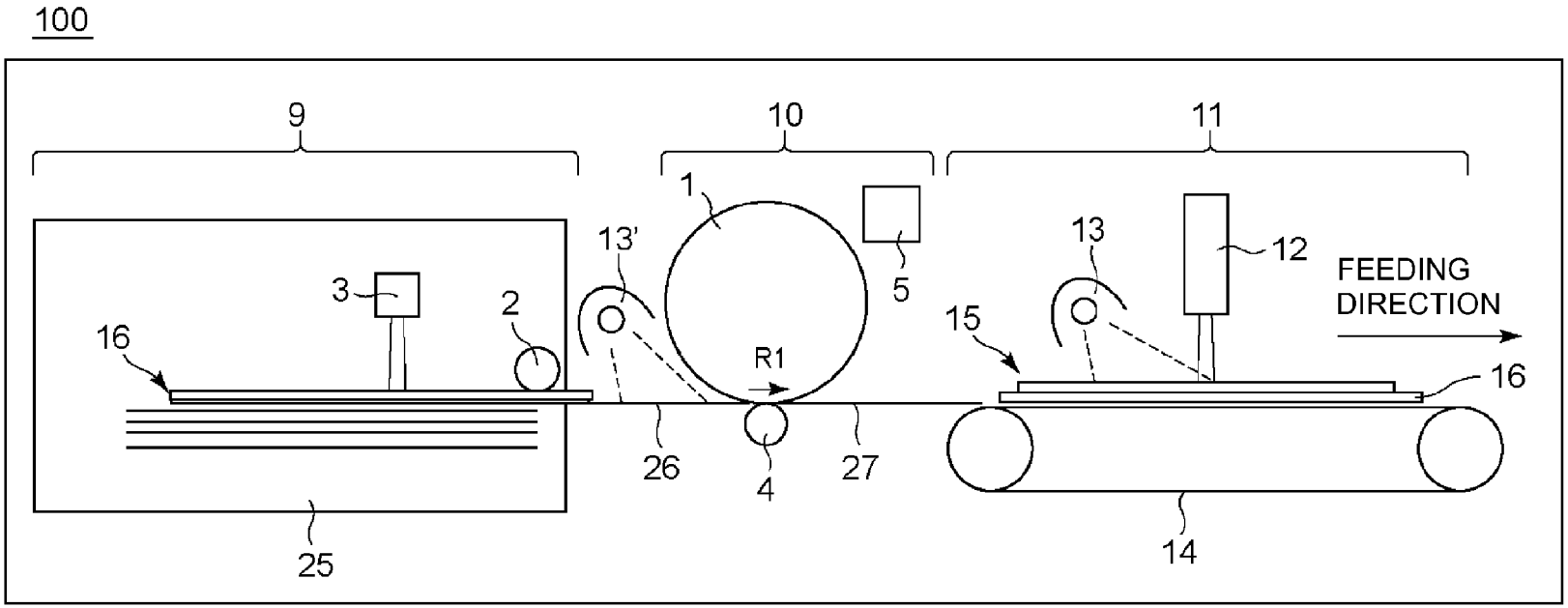
FIG. 20 is a schematic view showing a general structure of an image forming apparatus.

FIG. 19 is a schematic view showing a general structure of an image forming apparatus 100 in this embodiment. The image forming apparatus 100 includes an infrared irradiating device (infrared input irradiating portion) 13' as the heating portion for heating the recording material 16 to be irradiated with the ultraviolet radiation by the ultraviolet irradiating device 12. The infrared irradiating device 13' heats the recording material 16 on the feeding path 26. That is, the infrared irradiating device 13' heats the recording material 16 by irradiating the recording material 16 with the infrared input radiation in a period until the recording material 16 fed by the feeding mechanism 2 of the recording material feeding portion 9 is transferred by the transfer means 4. Incidentally, a detailed constitution of the infrared irradiating device 13' is similar to that of the above-described infrared irradiating device 13 except for arrangement thereof in the image forming apparatus 100, and therefore, a detailed description thereof will be omitted. The CPU 50 is electrically connected with the infrared irradiating device 13' as shown in FIG. 20 and controls ON/OFF and an output of the infrared irradiating device 13'.

Further, a constitution in which infrared irradiating devices 13' and 13 as heating portions for heating the recording material 16 to be irradiated with the ultraviolet radiation are provided in front of the image forming portion and behind the image forming portion, respectively, may also be employed.

Other constitutions are similar to those in Embodiment 1, and therefore will be omitted from description. Further, the constitution in this embodiment may also be applied to Embodiments 2 and 3.

Also in the constitution in this embodiment, CPU 50 can control, depending on the temperature of the recording material 16 fed to the infrared irradiating device 13, the output of the infrared irradiating device 13 so that the temperature of the recording material 16 when the recording material 16 is irradiated with the ultraviolet radiation falls within a target temperature range. As a result, irrespective of the temperature state of the recording material (recording material) 16 fed to the ultraviolet irradiating device 12, it is possible to suppress a lowering in quality of a resultant product due to improper curing of the liquid developer 15 and the deformation of the recording material 16. Further, it is possible to suppress an increase in electric power consumption by the infrared irradiating device 13.

[Embodiment 5]

In the above-described explanation, a measuring method of the temperature of the recording material 16 to be fed to the infrared irradiating device 13 was the method of measuring the surface temperature of the recording material 16 subjected to the image formation (Embodiment 1) or the constitution in which the ambient temperature of the image forming apparatus 100 is measured (Embodiment 2). However, a constitution in which as the information corresponding to the temperature of the recording material 16 to be fed to the infrared irradiating device 13, an ambient temperature in the cassette 25 in which the recording material 16 to be fed to the infrared irradiating device 13 is accommodated may also be employed.

In this case, a temperature sensor for measuring the ambient temperature of the cassette 25 functions as a detecting portion for detecting the temperature of the recording material 16 to be fed to the infrared irradiating device 13. The temperature sensor for measuring the ambient temperature of the cassette 25 is provided inside the cassette 25 (accommodating portion), and for example, a thermistor, a platinum resistance temperature sensor, a thermocouple or the like is used. The recording material 16 accommodated in the cassette 25 is adapted to the ambient temperature of the cassette 25.

The CPU 50 determines an output of the heating portion (e.g., the infrared irradiating device 13) so that the temperature of the recording material 16 when the recording material 16 is irradiated with the ultraviolet radiation falls within the target temperature range, on the basis of the temperature in the cassette 25 measured by the temperature sensor for measuring the ambient temperature of the cassette 25. Then, the CPU 50 controls the heating portion so as to provide the determined output. As a result, irrespective of the temperature state of the recording material (recording material) 16 to be fed to the ultraviolet irradiating device 12, it is possible to suppress a lowering in quality of a resultant product due to improper curing of the liquid developer 15 and the deformation of the recording material 16. Further, it is possible to suppress an increase in electric power consumption by the infrared irradiating device 13.

[Other Constitutions]

In Embodiments 1-5 described above, the constitution in which the infrared irradiating device 13 (or 13') is used as the heating portion for heating the recording material 16 before the ultraviolet irradiation was employed, but the heating portion may also employ a constitution in which the recording material 16 is heated from a back side (surface) of the recording material 16. Incidentally, the back side (surface) refers to a surface, of surfaces of the recording material 16, contacting the feeding paths 26 and 27 and the feeding belt 14. For example, a constitution in which a plate-like heater is provided in the feeding path 26 may also be employed, and a constitution in which a roller in which a heater is incorporated is provided inside the feeding belt 14 may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-252520 filed on Dec. 24, 2015, and 2016-189955 filed on Sep. 28, 2016, which are hereby incorporated by reference herein in their entirety.

What is claimed is:

1. An image forming apparatus comprising:

a recording material feeding portion configured to feed a recording material from an accommodating portion configured to accommodate the recording material;

an image forming portion configured to form an image, on the recording material fed by said recording material feeding portion, with a liquid developer containing toner and an ultraviolet curable agent;

a heating portion configured to heat the recording material on which the image is formed by said image forming portion;

an ultraviolet irradiating portion configured to irradiate the image on the recording material, with ultraviolet radiation, when the recording material is in an ultraviolet irradiation position and is already heated by said heating portion;

a detecting portion configured to detect a temperature corresponding to a temperature of the recording material which has not yet been heated by said heating portion; and a controller configured to control an output of said heating portion depending on the temperature detected by said detecting portion, so that the temperature of the recording material, when the recording material heated by said heating portion enters the ultraviolet irradiation position, is within a target temperature range that is set in advance.

2. An image forming apparatus according to claim 1, wherein said heating portion is configured to irradiate a first surface of the recording material, on which the image which is formed by said image forming portion and which has not yet been irradiated with the ultraviolet radiation, with infrared radiation.

3. An image forming apparatus according to claim 2, wherein said heating portion radiates an electromagnetic wave having a spectral radiant energy density in a wavelength region of 6000 nm or more and 11000 nm or less, which is 10% or more of a maximum of the spectral radiant energy density of said heating portion.

4. An image forming apparatus according to claim 1, wherein said controller sets the output of said heating portion at a first output when the temperature detected by said detecting portion is a first temperature, and sets the output of said heating portion at a second output larger than the first output when the temperature detected by said detecting portion is a second temperature lower than the first temperature.

5. An image forming apparatus according to claim 4, wherein said controller prohibits recording material feeding by said recording material feeding portion when the temperature detected by said detecting portion is not more than a third temperature lower than the second temperature.

6. An image forming apparatus according to claim 4, further comprising an acquiring portion configured to acquire information corresponding to a basis weight of the recording material, wherein said controller sets the output of said heating portion at the first output when the temperature detected by said detecting portion is the first temperature and when the basis weight acquired by said acquiring portion is a first basis weight, and wherein said controller sets the output of said heating portion at a third output smaller than the first output when the temperature detected by said detecting portion is the first temperature and when the basis weight acquired by said acquiring portion is a second basis weight smaller than the first basis weight.

7. An image forming apparatus according to claim 1, wherein said detecting portion is provided inside said accommodating portion and is configured to detect an ambient temperature in said accommodating portion.

8. An image forming apparatus according to claim 1, wherein said detecting portion is configured to detect an ambient temperature of said image forming apparatus.

9. An image forming apparatus comprising:

a recording material feeding portion configured to feed a recording material from an accommodating portion configured to accommodate the recording material;

a heating portion configured to heat the recording material fed by said recording material feeding portion;

an image forming portion configured to form an image, on the recording material already heated by said heating portion, with a liquid developer containing toner and an ultraviolet curable agent;

an ultraviolet irradiating portion configured to irradiate the image, formed on the recording material by said image forming portion, with ultraviolet radiation at an ultraviolet irradiation position;

a detecting portion configured to detect a temperature corresponding to a temperature of the recording material which has not yet been heated by said heating portion; and a controller configured to control an output of said heating portion depending on the temperature detected by said detecting portion so that the temperature of the recording material when the recording material, which is heated by said heating portion and on which the image is formed by said image forming portion, enters the ultraviolet irradiation position is within a target temperature range that is set in advance.

10. An image forming apparatus according to claim 9, wherein said heating portion is configured to irradiate the recording material, which has not yet been irradiated with the ultraviolet radiation, with infrared radiation.

11. An image forming apparatus according to claim 10, wherein said heating portion radiates an electromagnetic wave having a spectral radiant energy density in a wavelength region of 6000 nm or more and 11000 nm or less, which is 10% or more of a maximum of the spectral radiant energy density of said heating portion.

12. An image forming apparatus according to claim 9, wherein said controller sets the output of said heating portion at a first output when the temperature detected by said detecting portion is a first temperature, and sets the output of said heating portion at a second output larger than the first output when the temperature detected by said detecting portion is a second temperature lower than the first temperature.

13. An image forming apparatus according to claim 12, wherein said controller prohibits recording material feeding by said recording material feeding portion when the temperature detected by said detecting portion is not more than a third temperature lower than the second temperature.

14. An image forming apparatus according to claim 12, further comprising an acquiring portion configured to acquire information corresponding to a basis weight of the recording material, wherein said controller sets the output of said heating portion at the first output when the temperature detected by said detecting portion is the first temperature and when the basis weight acquired by said acquiring portion is a first basis weight, and wherein said controller sets the output of said heating portion at a third output smaller than the first output when the temperature detected by said detecting portion is the first temperature and when the basis weight acquired by said acquiring portion is a second basis weight smaller than the first basis weight.

15. An image forming apparatus according to claim 9, wherein said detecting portion is provided inside said accommodating portion and is configured to detect an ambient temperature in said accommodating portion.

16. An image forming apparatus according to claim 9, wherein said detecting portion is configured to detect an ambient temperature of said image forming apparatus.

* * * * *